US005558075A

United States Patent [19]

Maki et al.

[11] Patent Number: 5,558,075

[45] Date of Patent: Sep. 24, 1996

[54] FUEL METERING CONTROL SYSTEM FOR INTERNAL COMBUSTION ENGINE

[75] Inventors: Hidetaka Maki; Yusuke Hasegawa; Shusuke Akazaki, all of Wako, Japan

[73] Assignee: Honda Giken Kogyo Kabushiki Kaisha, Tokyo, Japan

[21] Appl. No.: 514,785

[22] Filed: Aug. 14, 1995

[30] Foreign Application Priority Data

Aug. 12, 1994 [JP] Japan ..... 6-212163
Aug. 12, 1994 [JP] Japan ..... 6-212164

[51] Int. Cl.[6] ..... F02D 41/14
[52] U.S. Cl. ..... 123/680
[58] Field of Search ..... 123/680, 492

[56] References Cited

U.S. PATENT DOCUMENTS

| | | | |
|---|---|---|---|
| 4,245,603 | 1/1981 | Pomerantz | 123/680 |
| 4,492,185 | 1/1985 | Takahashi et al. | 123/680 |
| 4,589,390 | 5/1986 | Wazaki et al. | 123/680 |
| 4,751,909 | 6/1988 | Otobe | 123/492 |
| 5,033,440 | 7/1991 | Kumagai et al. | 123/680 |
| 5,220,904 | 6/1993 | Miyashita et al. | 123/680 |
| 5,261,382 | 11/1993 | Nikolai | 123/680 |

FOREIGN PATENT DOCUMENTS

| | | |
|---|---|---|
| 1-110853 | 4/1989 | Japan . |
| 2-275043 | 11/1990 | Japan . |
| 4-209940 | 7/1992 | Japan . |
| 5-52140 | 3/1993 | Japan . |

OTHER PUBLICATIONS

Computrol (Corona Publishing Co., Ltd.) No. 27, pp. 28–41.
Automatic Control Handbook (Ohm Publishing Co., Ltd.) pp. 703–707.

"A Survey of Model Reference Adaptive Techniques—Theory and Applications" bu I. D. Landau In Automatica, vol. 10, pp. 353–379.

"Unification of Discrete Time Explicit Model Reference Adaptive Control Designs" by I. D. Landau et al In Automatica, vol. 17, No. 4, pp. 593–611.

"Combining Model Reference Adaptive Controllers and Stochastic Self-tuning Regulators" by I. D. Landau In Automatica vol. 18, No. 1, pp. 77–84.

*Primary Examiner*—Raymond A. Nelli
*Attorney, Agent, or Firm*—Nikaido Marmelstein Murray & Oram LLP

[57] ABSTRACT

A fuel metering control system for an internal combustion engine, having a feedback loop. In the system, the quantity of fuel injection (Tim) to be supplied to the engine (plant) is determined outside of the feedback loop. A first feedback correction coefficient (KSTR) is calculated using an adaptive law, while a second feedback correction coefficient (KLAF(KSTRL)), whose control response is inferior to the first feedback correction coefficient is calculated, using a PID control law. The feedback correction coefficients are calculated such that the plant output (air/fuel ratio) is brought to a desired (desired air/fuel ratio). A Variable(s) of one coefficients is replaced with a value of the other coefficient such that the one coefficient becomes close to the other. Moreover, the second coefficient (KLAF(KSTRL) is used at a time of returning from open-loop to the feedback control.

29 Claims, 16 Drawing Sheets

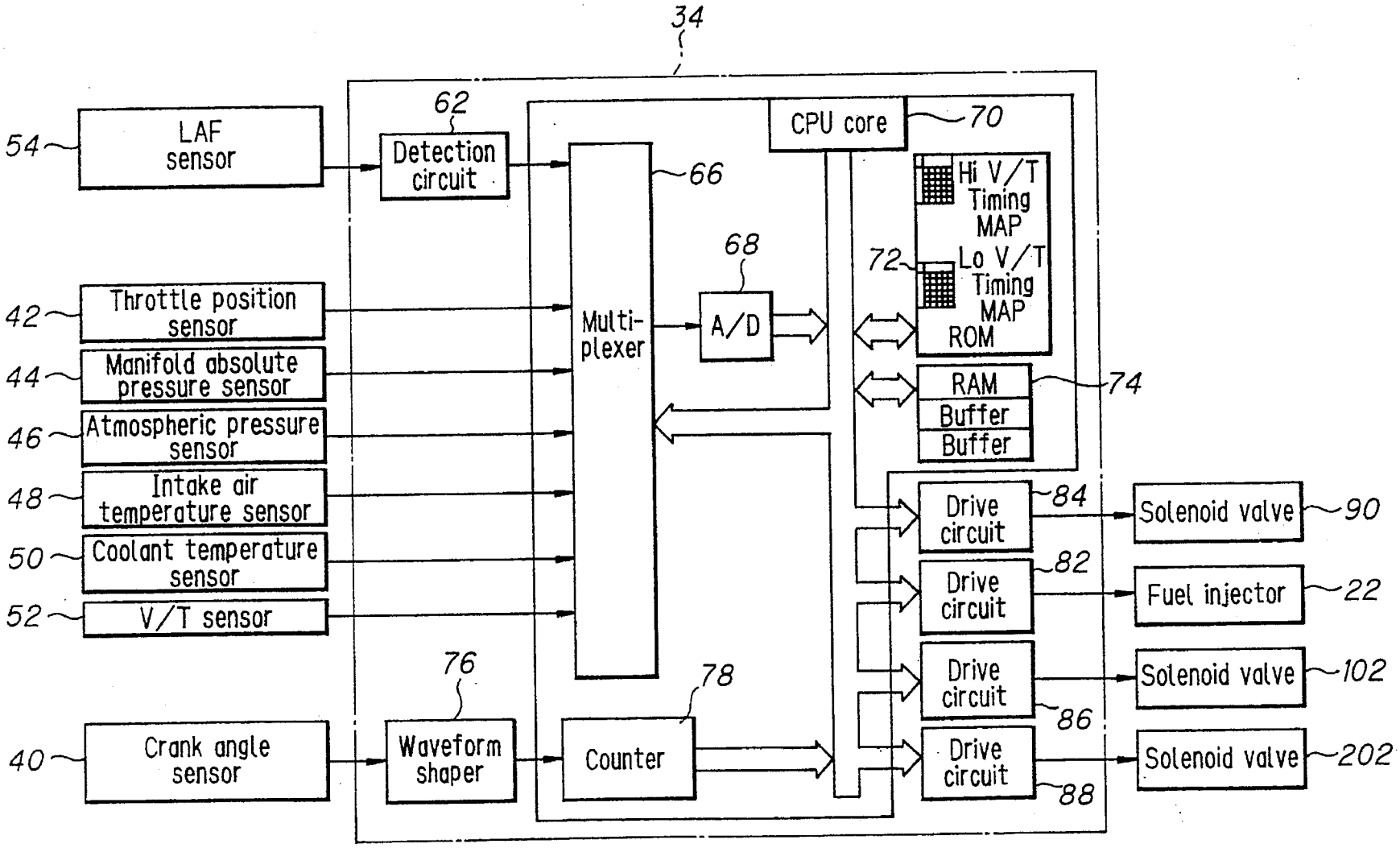
FIG. 3
34
CPU core
70
Hi V/T Timing MAP
Lo V/T Timing MAP
ROM
72
RAM
Buffer
Buffer
74
Drive circuit
84
Drive circuit
82
Drive circuit
86
Drive circuit
88
Solenoid valve
90
Fuel injector
22
Solenoid valve
102
Solenoid valve
202
A/D
68
Multi-plexer
66
Counter
78
Detection circuit
62
Waveform shaper
76
LAF sensor
54
Throttle position sensor
42
Manifold absolute pressure sensor
44
Atmospheric pressure sensor
46
Intake air temperature sensor
48
Coolant temperature sensor
50
V/T sensor
52
Crank angle sensor
40

TDC

FUEL CUT
ON
OFF
(FUEL SUPPLY RESUMED)
FUEL CUTOFF

A/F
RICH
14.7
LEAN
TRUE A/F
DETECTED A/F (KACT)

KSTR
LARGER
1
SMALLER

KLAF
LARGER
1
SMALLER

OPEN-LOOP
T1(C=1)
CLOSED-LOOP
(PID)
T2(C=5)
CLOSED-LOOP
(STR)
t

FUEL METERING CONTROL SYSTEM FOR INTERNAL COMBUSTION ENGINE

BACKGROUND OF THE INVENTION

1. Field of the Invention

This invention relates to a fuel metering control system for an internal combustion engine.

2. Description of the Prior Art

The PID control law is ordinarily used for fuel metering control for internal combustion engines. The control error between the desired value and the manipulated variable (control input) is multiplied by a P term (proportional term), an I term (integral term) and a D term (differential or derivative term) to obtain the feedback correction coefficient (feedback gain). In addition, it has recently been proposed to obtain the feedback correction coefficient by use of modern control theory or the like, as taught by Japanese Laid-Open Patent Application No. Hei 1(1989)-110,853. As the control response is relatively high in such cases, however, it may under some engine operating conditions become unstable owing to controlled variable fluctuation or oscillation, degrading the stability of control.

It has therefore been proposed, as in Japanese Laid-Open Patent Application No. Hei 4(1992)-209,940, to calculate a first feedback correction coefficient using modern control theory, calculate a second feedback correction coefficient whose control response is inferior to (or lesser than) that of the first feedback correction coefficient using the PI control law, and determine the controlled variable using the second feedback correction coefficient during engine deceleration, when combustion is unstable. For a similar reason, Japanese Laid-Open Patent Application No. Hei 5(1993)-52,140 proposes determining the controlled variable using a second feedback correction coefficient of inferior control response when the air/fuel ratio sensor is in the semi-activated state. In Japanese Patent Application No. Hei 6(1994)-66,594 (filed in the United States on Mar. 9, 1995 under the number of 08/401,430), for example, the assignee proposes a system for determining the quantity of fuel injection using an adaptive controller.

In fuel metering control, the supply of fuel is shut off during cruising and certain other operating conditions and, as shown in FIG. 16, it is controlled in an open-loop (O/L) fashion during the fuel cutoff period. Then when the fuel supply is resumed for obtaining a stoichiometric air/fuel ratio (14.7:1), for example, fuel is supplied based on the quantity of fuel injection determined in accordance with an empirically obtained characteristic. As a result, the true air/fuel ratio (A/F) jumps from the lean side to 14.7: 1. However, a certain amount of time is required for the supplied fuel to be combusted and for the combusted gas to reach the air/fuel ratio sensor. In addition, the air/fuel ratio sensor has a detection delay time. Because of this, the detected air/fuel ratio is not always the same as the true air/fuel ratio but, as shown by the broken line in FIG. 16, involves a relatively large error.

At this time, as soon as the high-control-response feedback correction coefficient (illustrated as KSTR in the figure) is determined based on a control law such as the adaptive control law proposed by the assignee, the adaptive controller determines the feedback correction coefficient KSTR so as to immediately eliminate the error between the desired value and the detected value. As this difference is caused by the sensor detection delay and the like, however, the detected value does not indicate the true air/fuel ratio. Since the adaptive controller nevertheless absorbs the relatively large difference all at one time, KSTR fluctuates widely as shown in FIG. 16, thereby also causing the controlled variable to fluctuate or oscillate and degrading the control stability.

The occurrence of this problem is not limited to that at the resumption of fuel supply following cutoff. It also arises at the time of resuming feedback control following full-load enrichment and of resuming stoichiometric air/fuel ratio control following lean-burn control. It also occurs when switching from perturbation control in which the desired air/fuel ratio is deliberately fluctuated to control using a fixed desired air/fuel ratio. In other words, the problem arises whenever a large variation occurs in the desired air/fuel ratio. None of the aforesaid prior art references offer any measure for overcoming this problem.

It is therefore preferable to determine one feedback correction coefficient of high control response using a control law such as the adaptive control law and another feedback correction coefficient of low control response using a control law such as the PID control law (illustrated as KLAF in the figure) and to select one or the other of the feedback correction coefficients depending on the engine operating condition. Since the different types of control laws have different characteristics, however, a sharp difference in level may arise between the two correction coefficients. Because of this, switching between the correction coefficients is liable to destabilize the controlled variable and degrade the control stability.

A first object of the invention is therefore to provide a fuel metering control system for an internal combustion engine which determines feedback correction coefficients different in control response using multiple types of control laws and which smooths the switching between the feedback correction coefficients, thereby improving fuel metering and air/fuel ratio controllability while ensuring control stability.

The aforesaid level difference between the correction coefficients is particularly pronounced at the time of switching from the feedback correction coefficient of low control response to the feedback correction coefficient of high-response.

A second object of the invention is therefore to provide a fuel metering control system for an internal combustion engine which determines feedback correction coefficients different in control response using multiple types of control laws, which selects one thereof in accordance with the engine operating condition, and particularly which smooths the switching from the feedback correction coefficient of low control response to the feedback correction coefficient of high control response, thereby improving fuel metering and air/fuel ratio controllability while ensuring control stability.

As mentioned earlier, the problem is apt to arise at the resumption of the feedback control following open-loop control due to fuel supply cutoff, full-load enrichment or EGR operation, etc.

A third object of the invention is therefore to provide a fuel metering control system for an internal combustion engine which determines feedback correction coefficients different in control response using multiple types of control laws, which selects one thereof in accordance with the engine operating condition, and particularly which smooths the switching when resuming the feedback control upon returning to an open-loop control implemented at fuel supply cutoff, full-load enrichment or EGR operation, etc., thereby maintaining optimum balance between control stability and control convergence.

Furthermore, calculation of a manipulated variable using the adaptive control law proposed by the assignee earlier can enhance control accuracy and eliminate any difference between a desired value and a detected value all at one time. Although this provides control with excellent convergence, the feedback correction coefficient calculated by the adaptive control law may become unstable under certain engine operating conditions. Use of the feedback correction coefficient without modification may therefore not always enhance control stability.

A fourth object of the invention is therefore to provide a fuel metering control system for an internal combustion engine which determines a feedback correction coefficient of high control response using the adaptive control law or some similar laws, and when the feedback correction coefficient fluctuates, which can continue the feedback control while implementing an effective measure for maintaining optimum balance between control stability and control convergence.

SUMMARY OF THE INVENTION

This invention achieves these objects by providing a system for controlling fuel metering for an internal combustion engine, comprising air/fuel ratio detecting means for detecting an air/fuel ratio (KACT) of an exhaust gas of the engine, engine operating condition detecting means for detecting an operating condition of the engine, fuel injection quantity determining means for determining a quantity of fuel injection (Tim) to be supplied to the engine, first feedback correction coefficient calculation means for calculating variables to determine a first feedback correction coefficient (KSTR) using a first control law having an algorithm expressed in a recursion formula, second feedback correction coefficient calculation means for calculating variables to determine a second feedback correction coefficient (KLAF(KSTRL)) whose control response is inferior to that of the first feedback correction coefficient using a second control law, switching means for switching the first feedback correction coefficient (KSTR) and the second feedback correction coefficient (KLAF(KSTRL)) therebetween and feedback control means for correcting a manipulated variable by the switched one of the feedback correction coefficients (KSTR, KLAF(KSTRL)) to bring at least one of the detected air/fuel ratio (KACT) and the quantity of fuel injection (Tim) to a desired value (KCMD). The characteristic feature is that said switching means replaces at least one of the variables of one of the feedback correction coefficients (KSTR, KLAF(KSTRL)) with a value to be used in a calculation of the other of the feedback correction coefficients (KLAF(KSTRL), KSTR).

BRIEF EXPLANATION OF THE DRAWINGS

These and other objects and advantages of the invention will be more apparent from the following description and drawings, in which:

FIG. 3 is a block diagram showing the details of the control unit illustrated in FIG. 1;

DETAILED DESCRIPTION OF THE PREFERRED EMBODIMENTS

Embodiments of the invention will now be explained with reference to the drawings.

Figure 1:
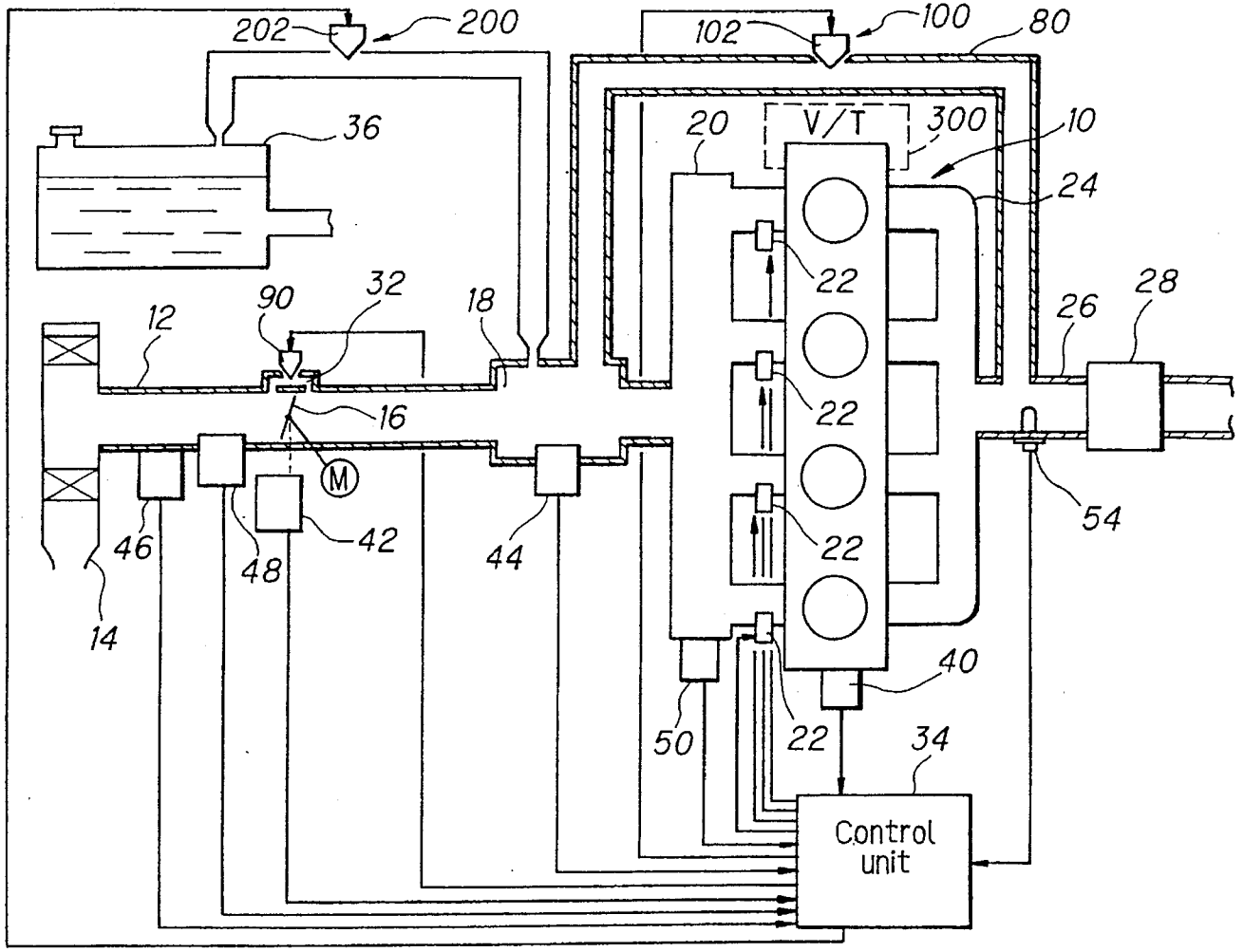
FIG. 1 is an overall block diagram showing a fuel metering control system according to the invention.

FIG. 1 is an overview of a fuel metering control system for an internal combustion engine according to the invention.

Reference numeral 10 in this figure designates an OHC in-line four-cylinder internal combustion engine. Air drawn in an air intake pipe 12 through an air cleaner 14 mounted on a far end thereof is supplied, while being adjusted by a throttle valve 16, to the first to fourth cylinders through a surge tank 18, an intake manifold 20 and two intake valves (not shown). A fuel injector 22 for injecting fuel is installed in the vicinity of the intake valves of each cylinder. The injected fuel mixes with the intake air to form an air-fuel mixture that is ignited in the associated cylinder by a spark plug (not shown). The resulting combustion of the air-fuel mixture drives down a piston (not shown).

The exhaust gas produced by the combustion is discharged through two exhaust valves (not shown) into an exhaust manifold 24, from where it passes through an exhaust pipe 26 to a catalytic converter (three-way catalyst) 28 where noxious components are removed therefrom before being discharged to the atmosphere. Not mechanically linked with the accelerator pedal (not shown), the throttle valve 16 is controlled to the desired degree of opening by a stepping motor M. In addition, the throttle valve 16 is bypassed by a bypass 32 provided in the vicinity thereof.

The engine 10 is equipped with an exhaust gas recirculation mechanism 100 and with a canister purge mechanism 200 connected between the air intake system and a fuel tank 36. Since these mechanisms are unrelated to the principle of the invention, however, they will not be explained in detail.

Figure 2:
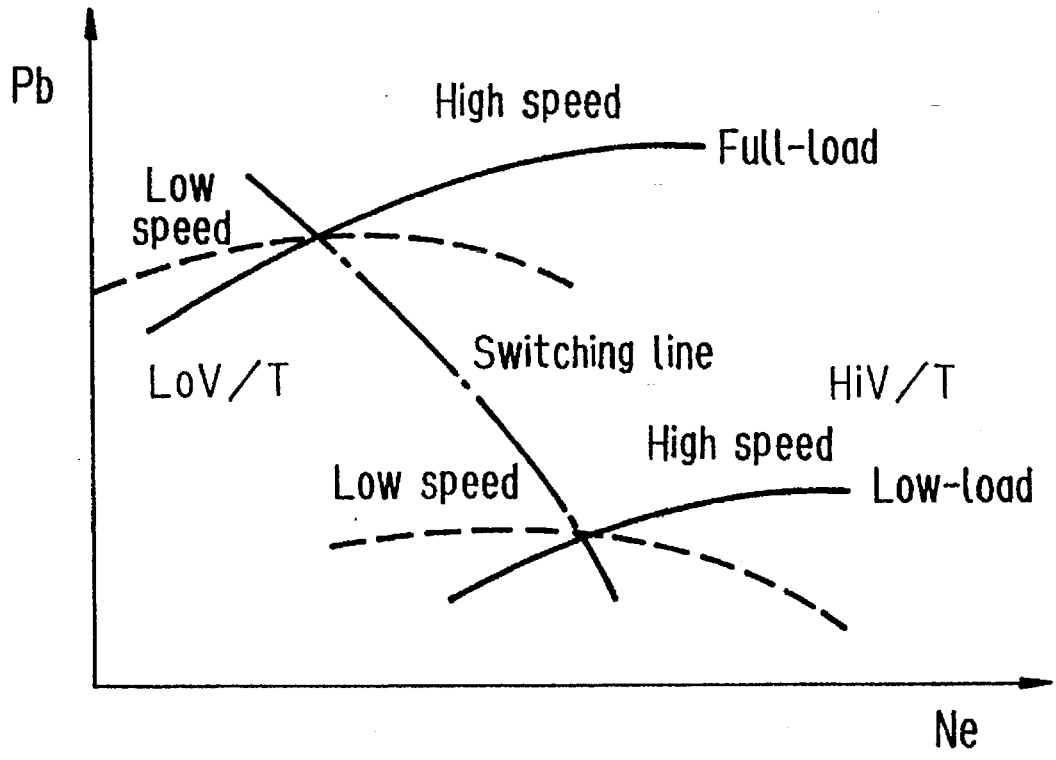
FIG. 2 is a graph showing the valve timing switching characteristics of a variable valve timing mechanism provided with the engine shown in FIG. 1.

The engine 10 is also equipped with a variable valve timing mechanism 300 (denoted as V/T in FIG. 1). As taught by Japanese Laid-open Patent Application No. Hei 2(1990)-275,043, for example, the variable valve timing mechanism 300 switches the opening/closing timing of the intake and/or exhaust valves between two types of timing characteristics, i.e, the characteristic for low engine speed named LoV/T and that for high engine speed named HiV/T as illustrated in FIG. 2 in response to engine speed Ne and manifold pressure Pb. Since this is a well-known mechanism, however, it will not be described further here. (Among the different ways of switching between valve timing characteristics is included that of deactivating one of the two intake valves.)

A crank angle sensor 40 for detecting the piston crank angles is provided in the distributor (not shown) of the internal combustion engine 10, a throttle position sensor 42 is provided for detecting the degree of opening of the throttle valve 16, and a manifold absolute pressure sensor 44 is provided for detecting the pressure of the intake manifold downstream of the throttle valve 16 in terms of the absolute value.

An atmospheric pressure sensor 46 for detecting atmospheric pressure is provided at an appropriate portion of the engine 10, an intake air temperature sensor 48 for detecting the temperature of the intake air is provided upstream of the throttle valve 16, and a coolant temperature sensor 50 for detecting the temperature of the engine coolant is provided at an appropriate portion of the engine. The engine 10 is further provided with a valve timing (V/T) sensor 52 (not shown in FIG. 1) which detects the valve timing characteristic selected by the variable valve timing mechanism 300 based on oil pressure.

Further, an air/fuel ratio sensor 54 constituted as an oxygen detector or oxygen sensor, is provided at the exhaust pipe 26 at, or downstream of, a confluence point in the exhaust system between the exhaust manifold 24 and the catalytic converter 28, where it detects the oxygen concentration in the exhaust gas at the confluence point and produces a signal (explained later). The outputs of all the sensors are sent to a control unit 34.

Details of the control unit 34 are shown in the block diagram of FIG. 3. The output of the air/fuel ratio sensor 54 is received by a detection circuit 62, where it is subjected to appropriate linearization processing for producing an output characterized in that it varies linearly with the oxygen concentration of the exhaust gas over a broad range extending from the lean side to the rich side. (The air/fuel ratio sensor will be referred to as "LAF sensor" in the figure and the remainder of this specification.)

The output of the detection circuit 62 is forwarded through a multiplexer 66 and an A/D converter 68 to a CPU (central processing unit). The CPU has a CPU core 70, a ROM (read-only memory) 72 and a RAM (random access memory) 74 and the output of the detection circuit 62 is A/D-converted once every prescribed crank angle (e.g., 15 degrees) and sequentially stored in buffers of the RAM 74. Similarly, the analog outputs of the throttle position sensor 42, etc., are input to the CPU through the multiplexer 66 and the A/D converter 68 and stored in the RAM 74.

The output of the crank angle sensor 40 is shaped by a waveform shaper 76 and has its output value counted by a counter 78. The result of the count is input to the CPU. In accordance with commands stored in the ROM 72, the CPU core 70 computes a manipulated variable in the manner described later and drives the fuel injectors 22 of the respective cylinders via a drive circuit 82. Operating via drive circuits 84, 86 and 88, the CPU core 70 also energizes/deenergizes a solenoid valve (Electric Air Control Valve) 90 (for opening and closing the bypass 32 to regulate the amount of secondary air), a solenoid valve 102 for controlling the amount of recirculated exhaust gas, and a solenoid valve 202 for controlling the amount of canister purge.

Figure 4:
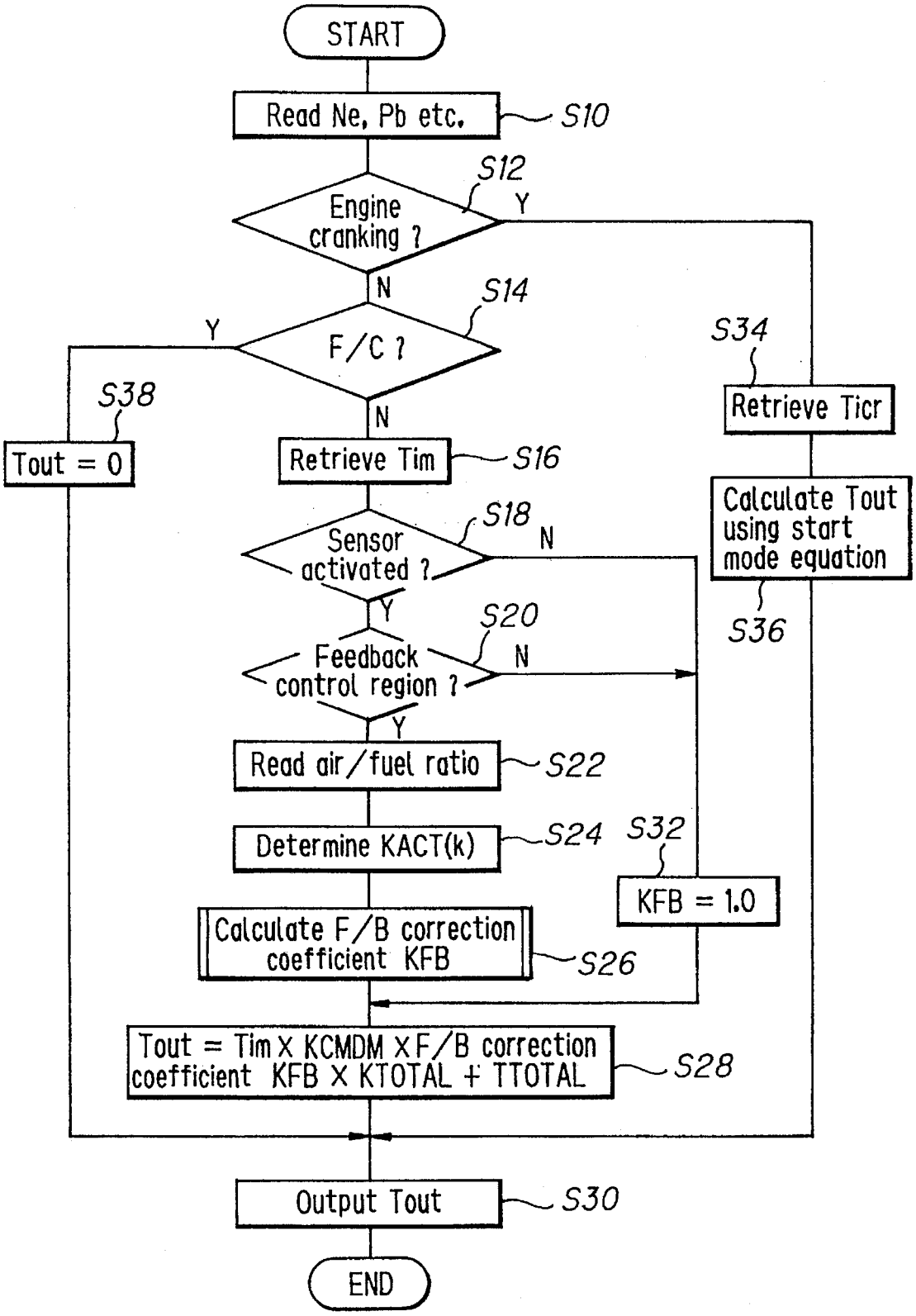
FIG. 4 is a flowchart showing the operation of the fuel metering control system according to the invention.

FIG. 4 is a flowchart showing the operation of the system. The routine of FIG. 4 is activated once every prescribed crank angle.

Figure 5:
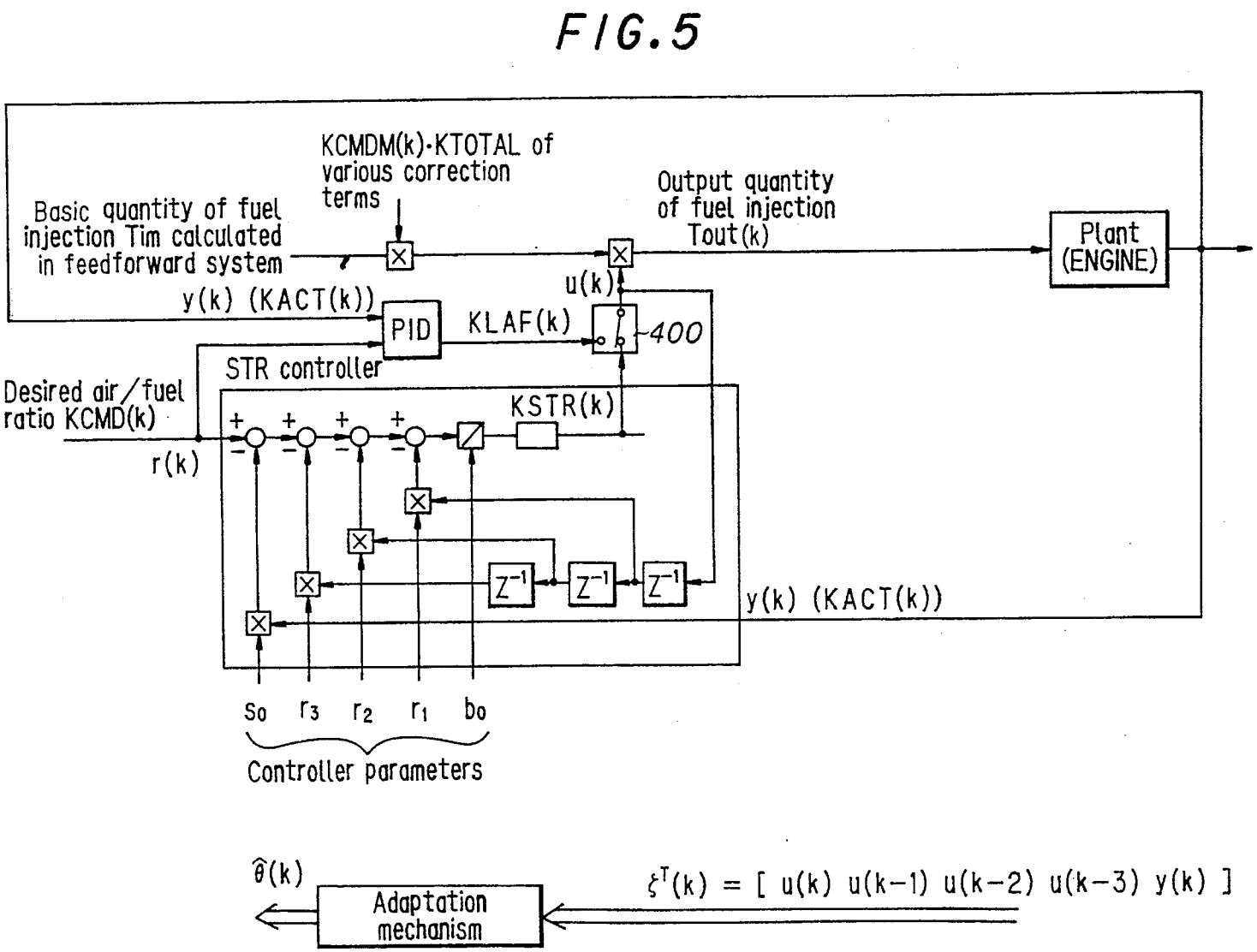
FIG. 5 is a block diagram similarly showing the operation of the system more functionally.

FIG. 5 is a block diagram illustrating the operation of the system more functionally. First explaining the system with reference to FIG. 5, the system is provided with a first calculation means constituted as an adaptive controller (STR type adaptive controller; indicated as an "STR controller" in the figure), which uses the adaptive control law based on a recursion formula to calculate a first feedback correction coefficient (indicated as "KSTR(k)" in the figure) so as to bring the detected air/fuel ratio (indicated as "KACT(k)") to a desired air/fuel ratio (indicated as "KCMD(k)") using the quantity of fuel injection as the manipulated variable (k: the sample number in discrete-time system).

In addition, the system is provided with a second calculation means constituted as a PID controller (indicated as "PID" in the figure), which uses a second type of control law, specifically, the PID control law, to calculate a second feedback correction coefficient (indicated as "KLAF(k)", hereinafter referred to as "PID correction coefficient" or "KLAF"), that is inferior in control response (lesser in control response) than the first feedback correction coefficient, so as to cause the detected air/fuel ratio KACT to equal the desired value KCMD similarly using the quantity of fuel injection as the manipulated variable. The output of the first calculation means or the second calculation means is selected based on the engine operating condition detected in the manner described latter, and the basic quantity of fuel injection Tim (calculated in a feedforward system in accordance with an empirically determined characteristic and stored as mapped data retrievable by engine speed and manifold pressure) is multiplied by the selected coefficient to obtain the output quantity of fuel injection Tout.

The first feedback correction coefficient (hereinafter referred to as the "adaptive correction coefficient" or "KSTR.") will here be explained.

The adaptive controller shown in FIG. 5 comprises an adaptive controller constituted as an STR controller and an adaptation mechanism (system parameter estimator) for estimating/identifying the controller (system) parameters. The desired value KCMD(k) and the controlled variable y(k) (plant output) of the fuel metering control feedback system are input to the STR controller, which thus receives a coefficient vector estimated/identified by the adaptation mechanism and generates the control input u(k).

One identification algorithm available for the adaptive control is that proposed by I.D. Landau et al. This method is described in, for example, Control (Corona Publishing Co., Ltd.) No. 27, pp. 28–41; *Automatic Control Handbook* (Ohm Publishing Co., Ltd.) pp. 703–707, "A Survey of Model Reference Adaptive Techniques—Theory and Applications" by I.D. Landau in *Automatica*, Vol. 10, pp. 353–379; "Unification of Discrete Time Explicit Model Reference Adaptive Control Designs" by I. D. Landau et al in *Automatica*, Vol. 17, No. 4, pp. 593–611; and "Combining Model Reference Adaptive Controllers and Stochastic Self-tuning Regulators" by I. D. Landau in *Automatica*, Vol. 18, No. 1, pp. 77–84.

The identification algorithm proposed by I.D. Landau et al. is used in the illustrated adaptive controller. In the identification algorithm proposed by I.D. Landau, if the polynomials of the denominator and numerator of the transfer function $A(Z^{-1})/B(Z^{-1})$ of the discrete controlled system are defined in the manner of Eq. 1—1 and Eq. 1–2 shown below, the controller parameters or system (adaptive) parameters $\hat{\theta}(k)$ which are made up of parameters as shown in Eq. 1–3 and are expressed as a vector(transpose matrix). And the input zeta (k) to the adaptation mechanism becomes that shown as Eq. 1–4 (transpose matrix). Here, there is taken as an example a plant in which m=1, n=1 and d=3, namely, the plant model is given in the form of linear system with three control cycles of dead time:

$$A(z^{-1}) = 1 + a_1 z^{-1} + \ldots + a_n z^{-n} \quad \text{Eq. 1-1}$$

$$B(z^{-1}) = b_0 + b_1 z^{-1} + \ldots + b_m z^{-m} \quad \text{Eq. 1-2}$$

$$\begin{aligned} \hat{\theta}^T(k) &= [\hat{b}_0(k), \hat{B}_R(z^{-1},k), \hat{S}(z^{-1},k)] \quad \text{Eq. 1-3} \\ &= [\hat{b}_0(k), \hat{r}_1(k), \ldots, r_{m+d-1}(k), s_0(k), \ldots, s_{n-1}(k)] \\ &= [b_0(k), r_1(k), r_2(k), r_3(k), s_0(k)] \end{aligned}$$

$$\begin{aligned} \zeta^T(k) &= [u(k), \ldots, u(k-m-d+1), \quad \text{Eq. 1-4} \\ &\quad y(k), \ldots, y(k-n+1)] \\ &= [u(k), u(k-1), u(k-2), u(k-3), y(k)] \end{aligned}$$

Here, the scalar quantity $\hat{b}_o^{-1}(k)$, the control factor $\hat{B}_R(Z^{-1}\ k)$ and $\hat{S}(Z^{-1}\ (k)$ shown in Eq. 1–3 are expressed respectively as Eq. 2 to Eq. 4.

$$\hat{b}_O^{-1}(k) = 1/b_O \quad \text{Eq. 2}$$

$$\begin{aligned} \hat{B}_R(Z^{-1},k) &= r_1 z^{-1} + r_2 z^{-2} + \ldots + \quad \text{Eq. 3} \\ &\quad r_{m+d-1} z^{-(m+d-1)} \\ &= r_1 z^{-1} + r_2 z^{-2} + r_3 z^{-3} \end{aligned}$$

$$\begin{aligned} \hat{S}(Z^{-1},k) &= s_0 + s_1 z^{-1} + \ldots + s_{n-1} z^{-(n-1)} \quad \text{Eq. 4} \\ &= s_0 \end{aligned}$$

The controller parameter vector (controller parameters) $\hat{\theta}(k)$ estimates/identifies coefficients of the scalar quantity and control factors and supplies to the STR controller. $\hat{\theta}(k)$ is calculated as Eq. 5 below. In Eq. 5, Γ (k) is a gain matrix (the (m+n+d)th order square matrix) that determines the estimation/identification speed of the controller parameter $\hat{\theta}$and e asterisk is a signal indicating the generalized estimation/identification error. They are represented by recursion formulas such as those of Eqs. 6 and 7.

$$\hat{\theta}(k) = \hat{\theta}(k-1) + \Gamma(k-1)\zeta(k-d)e^*(k) \quad \text{Eq. 5}$$

$$\Gamma(k) = \frac{1}{\lambda_1(k)} \left[\Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)}\right] \quad \text{Eq. 6}$$

$$e^*(k)\text{j} = \frac{D(z^{-1})y(k) - \theta^T(k-1)\zeta(k-d)}{1 + \zeta^T(k-d)\Gamma(k-1)\zeta(k-d)} \quad \text{Eq. 7}$$

Various specific algorithms are given depending on the selection of $\text{lambda}_1$, $\text{lambda}_2$ in Eq. 6. lambda 1(k)=1, lambda 2(k) =lambda (0<lambda<2) gives the gradually-decreasing gain algorithm (least square method when lambda=1) and lambda 1(k)=lambda 1 (0<lambda 1<lambda 2(k)=lambda 2 (0<lambda 2<lambda) gives the variable-gain algorithm (weighted least square method when lambda 2=1). Further, defining lambda 1(k)/lambda 2(k)=σ and representing lambda 3 as in Eq. 8, the constant-trace algorithm is obtained by defining lambda 1(k)=lambda 3(k). Moreover, lambda 1(k)=1, lambda 2(k)=0 gives the constant-gain algorithm. As is clear from Eq. 6, in this case Γ(k)=Γ(k–1), resulting in the constant value Γ(k)=Γ.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \quad \text{Eq. 8}$$

In the diagram of FIG. 5, the STR controller (adaptive controller) and the adaptation mechanism (system parameter estimator) are placed outside the system for calculating the quantity of fuel injection and operate to calculate the feedback correction coefficient KSTR(k) so as to adaptively bring the detected value KACT(k) to the desired value KCMD(k–d') (where d' is the dead time before KCMD is reflected in KACT as mentioned repeatedly). In other words, the STR controller receives the coefficient vector $\hat{\theta}(k)$ adaptively estimated/identified by the adaptation mechanism and forms a feedback compensator so as to bring it to the desired value KCMD(k–d'). The basic quantity of fuel injection Tim is multiplied by other correction terms KCMDM(k), KTOTAL (both explained later) and the calculated feedback correction coefficient KSTR(k) and the corrected quantity of fuel injection is supplied to the controlled plant (internal combustion engine) as the output quantity of fuel injection Tout(k).

Thus the adaptive feedback correction coefficient KSTR(k) and the detected value KACT(k) are determined and input to the adaptation mechanism, which calculates the controller parameter vector $\hat{\theta}(k)$ which is input to the STR controller. The desired value KCMD(k) is applied as input to the STR controller. Based on these (internal or intermediate) variables, the STR controller uses a recursion formula to calculate the feedback correction coefficient KSTR(k) so as to bring the detected value KACT(k)to the desired value KCMD(k). The feedback correction coefficient KSTR(k) is specifically calculated as shown by Eq. 9:

$$KSTR(k) = \frac{KCMD(k-d') - s_0 x y(k) - r_1 x KSTR(k-1) - r_2 x KSTR(k-2) - r_3 x KSTR(k-3)}{b_0} \quad \text{Eq. 9}$$

As explained in the foregoing, the detected value KACT(k) and the desired value KCMD(k) are also input to the PID controller, which calculates the PID correction coefficient KLAF(k) based on the PID control law so as to eliminate the control error between the detected value at the exhaust system confluence point and the desired value. One or the other of the feedback correction coefficient KSTR, obtained by the adaptive control law, and the PID correction coefficient KLAF, obtained using the PID control law, is selected to be used in determining the fuel injection calculation quantity by a switching mechanism 400 shown in FIG. 5.

Next, the calculation of the PID correction coefficient will be explained.

First, the control error DKAF between the desired air/fuel ratio KCMD and the detected air/fuel ratio KACT is calculated as:

DKAF(k)=KCMD(k–d')–KACT(k).

In this equation, KCMD(k–d') is the desired air/fuel ratio (in which d' indicates the dead time before KCMD is reflected in KACT and thus signifies the desired air/fuel ratio before the dead time control cycle), and KACT(k) is the detected air/fuel ratio (in the current control (program) cycle). In this embodiment, however, the desired value KCMD and the detected value KACT are represented as the equivalence ratio so as to facilitate the calculation, namely, as Mst/M'1/lambda (Mst: stoichiometric air/fuel ratio, M=A/F (A: air mass flow rate, F: fuel mass flow rate), and lambda=excess air factor).

Next, the control error DKAF(k) is multiplied by specific coefficients to obtain variables, i.e., the P (proportional) term KLAFP(k), I (integral) term KLAFI(k), and D (differential or derivative) term KLAFD(k) as:

P term: KLAFP(k)=DKAF(k)×KP

I term: KLAFI(k)=KLAFI(k−1)+DKAF(k)×KI

D term: KLAFD(k)=(DKAF(k)−DKAF(k−1))×KD.

Thus, the P term is calculated by multiplying the error by the proportional gain KP, the I term is calculated by adding the value of KLAFI(k−1), the feedback correction coefficient in the preceding control cycle (k−1), to the product of the error and the integral gain KI, and the D term is calculated by multiplying the difference between the value of DKAF(k), the error in the current control cycle (k), and the value of DKAF(k−1), the error in the preceding control cycle (k−1), by the differential gain KD. The gains KP, KI and KD are calculated based on the engine speed and the engine load. Specifically, they are retrieved from a map using the engine speed Ne and the manifold pressure Pb as address data. Finally, KLAF(k), the value of the feedback correction coefficient according to the PID control law in the current control cycle, is calculated by summing the thus-obtained values:

$$KLAF(k)=KLAFP(k)+KLAFI(k)+KLAFD(k).$$

It should be noted that the offset of 1.0 is assumed to be included in I term KLAFI(k) so that the feedback correction coefficient is a multiplication coefficient (namely, the I term KLAFI(k) is given an initial value of 1.0).

It should be also noted here that when the PID correction coefficient KLAF is selected for fuel injection quantity calculation, the STR controller holds the controller parameters such that the adaptive correction coefficient KSTR is 1.0 (initial value) or near one.

The thus-obtained adaptive correction coefficient KSTR and the PID correction coefficient KLAF are generally named as KFB and either of them is used for the fuel injection quantity correction. Specifically, the basic quantity of fuel injection Tim is multiplied by the feedback correction coefficient KFB to determine the output quantity of fuel injection Tout which is then supplied to the controlled plant (engine). More specifically, the output quantity of fuel injection is calculated as follows:

$$Tout=Tim\times KCMDM\times KFB\times KTOTAL+TTOTAL$$

Here, KCMDM is a correction coefficient and is determined based on the desired air/fuel ratio (more precisely the equivalence ratio) KCMD. Specifically, in order to correct the quantity of fuel injection by the desired air/fuel ratio through multiplication, the air/fuel ratio is determined as the equivalence ratio and is adjusted by the charging efficiency. More specifically, the charging efficiency of intake air varies as the evaporation heat varies. For that reason, the value KCMD is adjusted by this and is renamed as KCMDM.

KTOTAL is the total value of the other coefficients of the various corrections for coolant temperature, etc., conducted by multiplication terms and TTOTAL indicates the total value of the various corrections for atmospheric pressure, etc., conducted by addition terms (but does not include the injector dead time, etc., which is added separately at the time of outputting the output quantity of fuel injection Tout).

What characterizes FIG. 5 is, first, that the STR controller is placed outside the system for calculating the quantity of fuel injection and not the quantity of fuel injection but the air/fuel ratio, more precisely the equivalence ratio is defined as the desired value. In other words, the manipulated variable is indicated in terms of the quantity of fuel injection and the adaptation mechanism operates to determine the feedback correction coefficient KSTR so as to bring the air/fuel ratio produced as a result of fuel injection in the exhaust system to equal the desired value, thereby increasing robustness against disturbance. As this was described in the assignees Japanese Patent Application No. Hei 6(1994)-66, 594, it will not be explained in detail here.

A second characteristic feature is that the manipulated variable is determined as the product of the feedback correction coefficient and the basic quantity of fuel injection. This results in a marked improvement in the control convergence. On the other hand, the configuration has the drawback that the controlled value tends to fluctuate if the manipulated variable is inappropriately determined.

Based on the above, the operation of the system will be explained with reference to FIG. 4.

In FIG. 4, the program starts at S10 in which the detected engine speed Ne and manifold pressure Pb, etc., are read, and proceeds to S12 in which a check is made as to whether or not the engine is cranking, and if it is not, to S14 in which a check is made as to whether the supply of fuel has been cut off. Fuel cutoff is implemented under specific engine operating conditions, such as when the throttle is fully closed and the engine speed is higher than a prescribed value, at which time the supply of fuel is stopped and open-loop control is effected.

If it is found in S14 that fuel cutoff is not implemented, the program proceeds to S16 in which the aforesaid basic quantity of fuel injection Tim is calculated by retrieval from the aforesaid map using the detected engine speed Ne and manifold pressure Pb as address data. Next, the program proceeds to S18 in which it is checked whether activation of the LAF sensor 54 is complete. This is done by comparing the difference between the output voltage and the center voltage of the LAF sensor 54 with a prescribed value (0.4 V, for example) and determining that activation is complete when the difference is smaller than the prescribed value.

If S18 finds that activation is complete, the program goes to S20 in which it is checked whether the engine operating condition is in the feedback control region. This is conducted using a separate routine (not shown in the drawing). For example, when the engine operating condition has changed suddenly, such as during full-load enrichment, high engine speed, EGR or the like, fuel metering is controlled not in the closed-loop manner, but in an open-loop fashion.

If the result is affirmative, the program goes to S22 in which the output of the LAF sensor is read, to S24 in which the air/fuel ratio, more precisely the equivalence ratio KACT(k) is determined or calculated from the output, and to S26 in which the feedback correction coefficient KFB (the general name for KSTR and KLAF) is calculated. As mentioned earlier, k is used to mean a discrete variable in the specification and the sample number in the discrete-time system.

Figure 6:
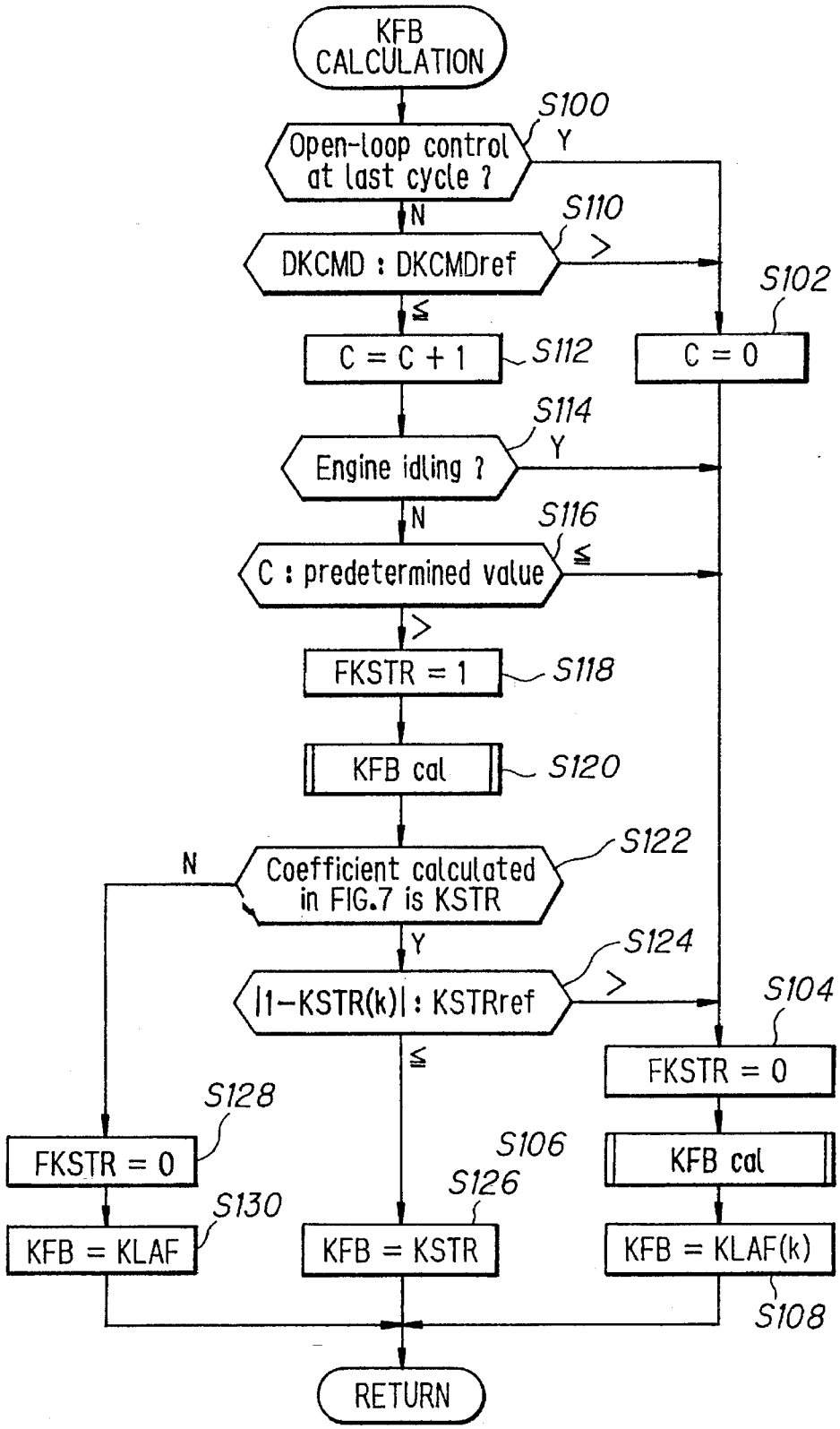
FIG. 6 is a subroutine flowchart of FIG. 4 showing the calculation of a feedback correction coefficient KFB.

The subroutine for this calculation is shown by the flowchart of FIG. 6.

First, in S100, it is checked whether open-loop control was in effect during the preceding cycle (during the last control (calculation) cycle, namely, at the preceding routine activation time). If open-loop control was in effect during fuel cutoff or the like in the preceding cycle, the result in S100 is affirmative. In this case, a counter value C is reset to 0 in S102, the bit of a flag FKSTR is reset to 0 in S104, and the feedback correction coefficient KFB is calculated in S106. The resetting of the bit of flag FKSTR to 0 in S104 indicates that the feedback correction coefficient is to be determined by the PID control law. Further, as explained hereafter, setting the bit of the flag FKSTR to 1 indicates that the feedback correction coefficient is to be determined by the adaptive control law.

Figure 7:
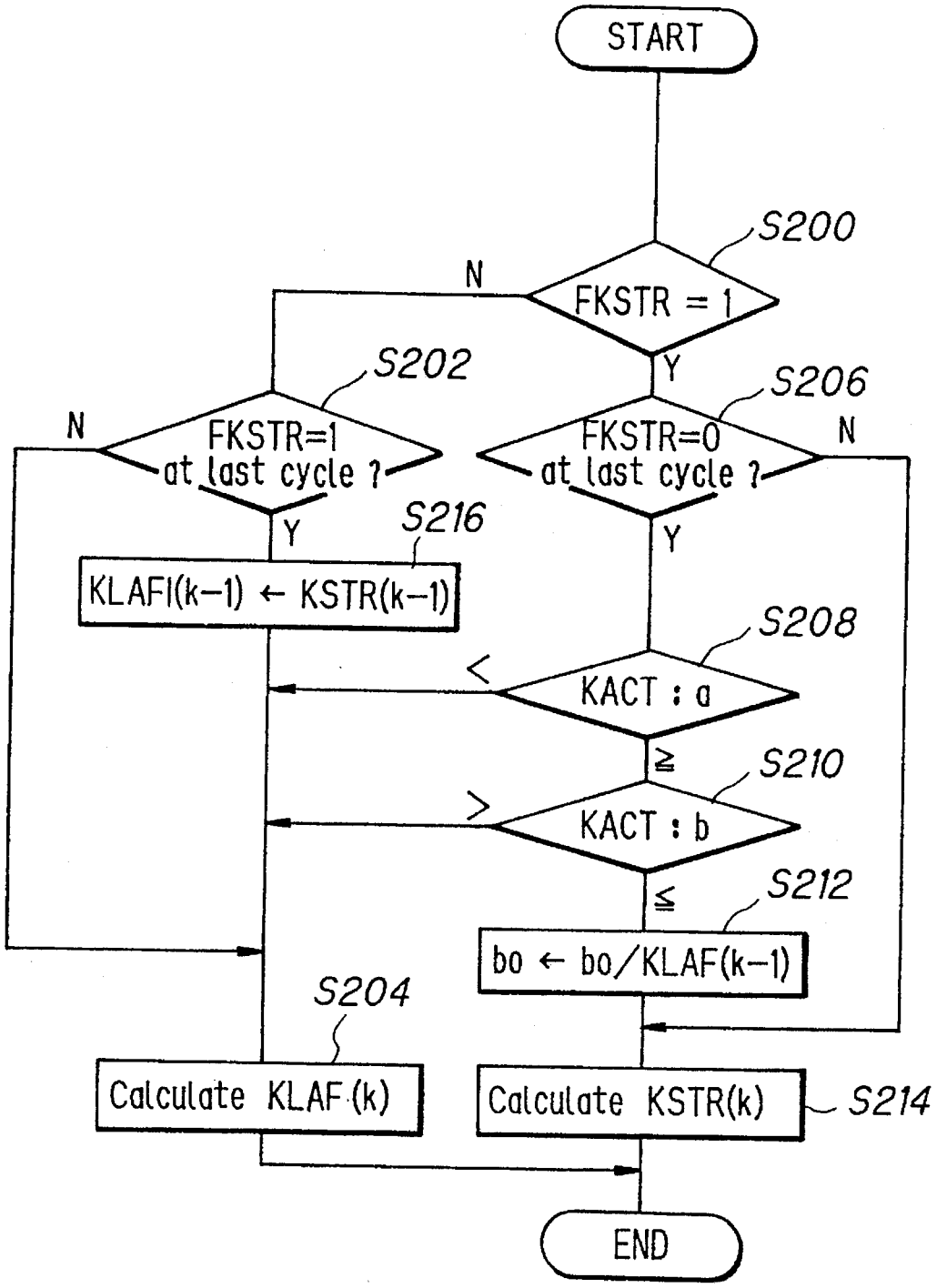
FIG. 7 is a subroutine flowchart of FIG. 5 showing the calculation of the feedback correction coefficient more specifically.

A subroutine showing the specific procedures for calculating the feedback correction coefficient KFB is shown by the flowchart of FIG. 7. In S200, it is checked whether the bit of flag FKSTR is set to 1, i.e., as to whether or not the operating condition is in the STR (controller) operation region. Since this flag was reset to 0 in S104 of the subroutine of FIG. 6, the result in this step is NO and it is checked in S202 whether the bit of flag FKSTR was set to 1 in the preceding control cycle, i.e., as to whether or not the operating condition was in the STR (controller) operation region in the preceding cycle. Since the result here is naturally NO, the program moves to S204 where PID correction coefficient KLAF(k) is calculated by the PID controller based on PID control law in the manner described earlier. More precisely, the PID correction coefficient KLAF(k) calculated by the PID controller is selected. Returning to the subroutine of FIG. 6, KFB is set to KLAF(k) in S108.

In the subroutine of FIG. 6, if it is found in S100 that open-loop control was not in effect in the preceding control cycle, i.e., that feedback control was resumed following open-loop control, the difference DKCMD between KCMD(k−1), the value of the desired value in the preceding control cycle, and the value of KCMD(k), the desired value in the current control cycle, is calculated and compared with a reference value DKCMDref in Sl10. If the difference DKCMD is found to exceed the reference value DKCMDref, the PID correction coefficient is calculated by PID control law in S102 and the following steps.

This is because when the change in the desired air/fuel ratio is large, a situation similar to that when fuel cutoff is resumed arises. Specifically, the detected value probably does not indicate the true value owing to air/fuel ratio detection delay and the like, so that, similarly, the controlled variable may become unstable. Large change occurs in the desired equivalent ratio, for example, when normal fuel supply is resumed following full-load enrichment, when stoichiometric air/fuel ratio control is resumed following lean-burn control (at an air/fuel ratio of 20:1 or leaner, for example), and when stoichiometric air/fuel ratio control using a fixed desired air/fuel ratio is resumed following perturbation control in which the desired air/fuel ratio is fluctuated.

On the other hand, if Sl10 finds the difference DKCMD to be equal to or smaller than reference value DKCMDref, the counter value C is incremented in Sl12, it is checked in Sl14 whether the engine is idling, and if the result is YES, the feedback correction coefficient is calculated by PID control law in S104 and the following steps. This is because the substantially stable engine operating condition during engine idling makes a high gain, such as that by the adaptive control law, unnecessary. Another reason for adopting a relatively low gain based on the PID control law during idling is to avoid possible conflict between the fuel metering and air/fuel ratio feedback control and the intake air quantity control conducted by use of the EACV 90 for maintaining the engine speed constant during idling.

If Sl14 finds that the engine operating condition is not in the idling region, the counter value C is compared with a predetermined value, 5 for example, in Sl16. So long as the counter value C is found to be at or below the predetermined value, the PID correction coefficient KLAF(k) calculated by PID control law is selected through the procedures of S104, S106, S200, S202 (S216), S204 and S108.

Figures 16A, 16B, 16C, 16D, 16E, 16F:
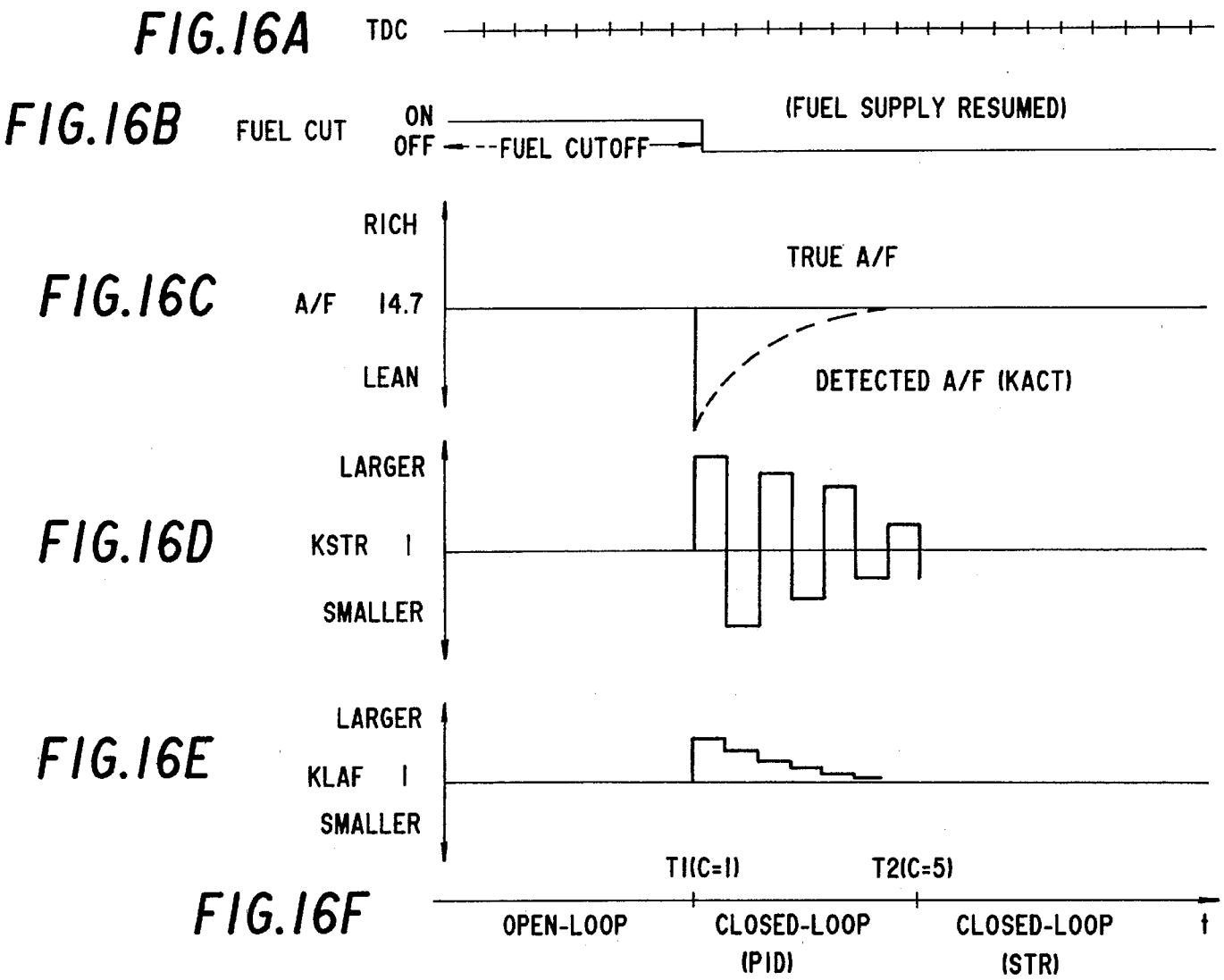
FIG. 16 is a timing chart showing the air/fuel ratio detection delay when the fuel supply is resumed after the fuel was cut off.

In other words, during the period from time T1 at which fuel cutoff is discontinued in FIG. 16 and feedback control is resumed following open-loop control (when C=1, as mentioned in connection with FIG. 6) to time T2 (counter value C=5), the feedback correction coefficient is set to the value KLAF determined by the PID controller using PID control law. Unlike the feedback correction coefficient KSTR determined by the STR controller, the PID correction coefficient KLAF according to PID control law does not absorb the control error DKAF between the desired value and the detected value all at one time but exhibits a relatively gradual absorption characteristic.

Thus, even when, as in FIG. 16, a relatively large difference arises owing to the delay up to completion of combustion of fuel after resuming fuel supply and the air/fuel ratio sensor detection delay, the correction coefficient does not become unstable as in the case of the STR controller and, therefore, does not cause instability of the controlled variable (plant output). The predetermined value is set to 5 (i.e., 5 control cycles or TDCs (TDC: Top Dead Center)) in this embodiment because this period is considered sufficient for absorbing the combustion delay and detection delay. Alternatively, the period (predetermined value) can be determined from the engine speed, engine load and other such factors affecting the exhaust gas transport delay parameters. For instance, the predetermined value can be set small when the engine speed and manifold pressure produce a small exhaust gas transport delay parameter and be set large when they produce a large exhaust gas transport delay parameter.

Next, if Sl16 in the subroutine of FIG. 6 finds that counter value C exceeds the prescribed value, namely, is 6 or larger, the bit of the flag FKSTR is set to 1 in S118 and the feedback correction coefficient KFB is calculated according to the subroutine of FIG. 6 in S120. In this case, the result of the check in S200 of the subroutine of FIG. 7 becomes YES and a check is made in S206 as to whether or not the bit of flag FKSTR was reset to 0 in the preceding control cycle, i.e., whether or not the operating condition was in the PID operation region in the preceding cycle.

If this is the first time that the counter value exceeded the predetermined value, the result of this check is YES, in which case the detected value KACT(k) is compared with a lower limit value a, e.g., 0.95, in S208. If the detected value is found to be equal to or greater than the lower limit value, the detected value is compared with an upper limit value b of, say, 1.05 in S210. If it is found to be equal to or smaller than the upper limit value, the program advances through S212 (explained later) to S214, where the adaptive correction coefficient KSTR(k) is calculated using the STR controller. Thus, the detected value is determined to be 1.0 or thereabout when it falls within the upper and lower limits b, a, and KSTR(k) is calculated. More precisely, the adaptive correction coefficient KSTR(k) calculated by the STR controller is selected. This is because, when the air/fuel ratio is controlled toward the stoichiometric air/fuel ratio, the fact that the detected value is 1.0 or thereabout suggests the control error small. At that situation, the feedback correction coefficient, whichever it may be KLAF determined using the PID control law or KSTR calculated using the adaptive control law, becomes 1.0 or thereabout. This will allow smooth switching from KLAF to KSTR.

If S208 finds that the detected value is below the lower limit value a or S210 finds that the detected value exceeds the upper limit value b, the program goes to S204 where the feedback correction coefficient is calculated based on PID control. In other words, a switch is made from PID control to STR (adaptive) control when the engine operating condition is in the STR controller operation region and the detected value KACT is 1 or in the vicinity thereof. This enables the switch from PID control to STR (adaptive) control to be made smoothly and prevents fluctuation of the controlled variable.

If S210 finds that the detected equivalent ratio KACT(k) is at or below the upper limit value b, the program moves to S212 where, as shown in FIG. 7, the aforesaid scalar quantity $b_0$, the value determining the gain in the STR controller, is set to or replaced with the value obtained by dividing the same by KLAF(k−1), the value of the PID correction coefficient by PID control in the preceding control cycle, whereafter the feedback correction coefficient KSTR(k) determined by the STR controller is calculated in S214.

In other words, the STR controller basically calculates the feedback correction coefficient KSTR(k) in accordance with Eq. 9 as explained earlier. When the result in S206 is affirmative and the program moves to S208 and the succeeding steps, however, this means that the feedback correction coefficient was determined based on PID control in the preceding control cycle. As was explained earlier with reference to the configuration of FIG. 5, moreover, the feedback correction coefficient KSTR is fixed at 1 in the STR controller when feedback correction coefficient is determined by PID control. When determination of the feedback correction coefficient KSTR by the STR controller is resumed, therefore, the controlled variable becomes unstable if the value of KSTR deviates greatly from 1.

In light of this, the scalar quantity $b_0$ (in the controller parameters that are held by the STR controller such that the adaptive correction coefficient KSTR is fixed at 1.0 (initial value) or thereabout) is divided by the value of the feedback correction coefficient by PID control in the preceding control cycle. Thus, as can be seen from Eq. 10, since the first term is 1, the value of the second term KLAF(k−1) becomes the correction coefficient KSTR(k) of the current control cycle, provided that the controller parameters are held such that KSTR=1.0 as just mentioned:

$$KSTR(k) = \frac{KCMD(k-d') - s_0xy(k) - r_1xKSTR(k-1) - r_2xKSTR(k-2) - r_3xKSTR(k-3)}{b_0} \times KLAF(k-1) \quad \text{Eq. 10}$$

$$KLAF(k-1) = 1 \times KLAF(k-1) = KLAF(k-1)$$

As a result, the detected value KACT is 1 or near 1 in S208 and S210 and, in addition, the switch from PID control to STR control can be made smoothly.

In the subroutine of FIG. 7, if S202 finds that the engine operating condition was in the STR (controller) operation region in the preceding control cycle, the value of KSTR(k−1), the adaptive correction coefficient in the preceding control cycle, is set to or replaced with the value of KLAFI(k−1), the I term of the PID correction coefficient in the preceding cycle, in S216. As a result, when KLAF(k) is calculated in S204, the I term KLAFI thereof becomes:

$$KLAFI(k)=KSTR(k-1)+DKAF(k)\times KI$$

and the calculated I term is added to the P term and the D term to obtain KLAF(k).

This method is adopted because of the rapid change which may occur in the integral term when the feedback correction coefficient is calculated following a switch from adaptive control to PID control. By using the value of KSTR to determine the initial value of the PID correction coefficient in the foregoing manner, the difference between the correction coefficient KSTR(k−1) and the correction coefficient KLAF(k) can be kept small. At the time of switching from STR control to PID control, therefore, the difference in the gain of the feedback correction coefficient can be kept small and the transition can be made smoothly and continuously, thereby preventing sudden change in the controlled variable.

If S200 in the subroutine of FIG. 7 finds that the engine operating condition is in the STR (controller) operation region and S206 finds that the operating condition was not in the PID operation region in the preceding control cycle either, the feedback correction coefficient KSTR(k) is calculated based on the STR controller in S214. This calculation is made in accordance with Eq. 9 as explained earlier.

Next, in S122 of the subroutine of FIG. 6, it is checked whether the correction coefficient calculated by the subroutine of FIG. 7 is KSTR, and if it is, the difference between 1.0 and KSTR(k) is calculated and its absolute value is compared with a threshold value KSTRref in S124.

Figure 8:
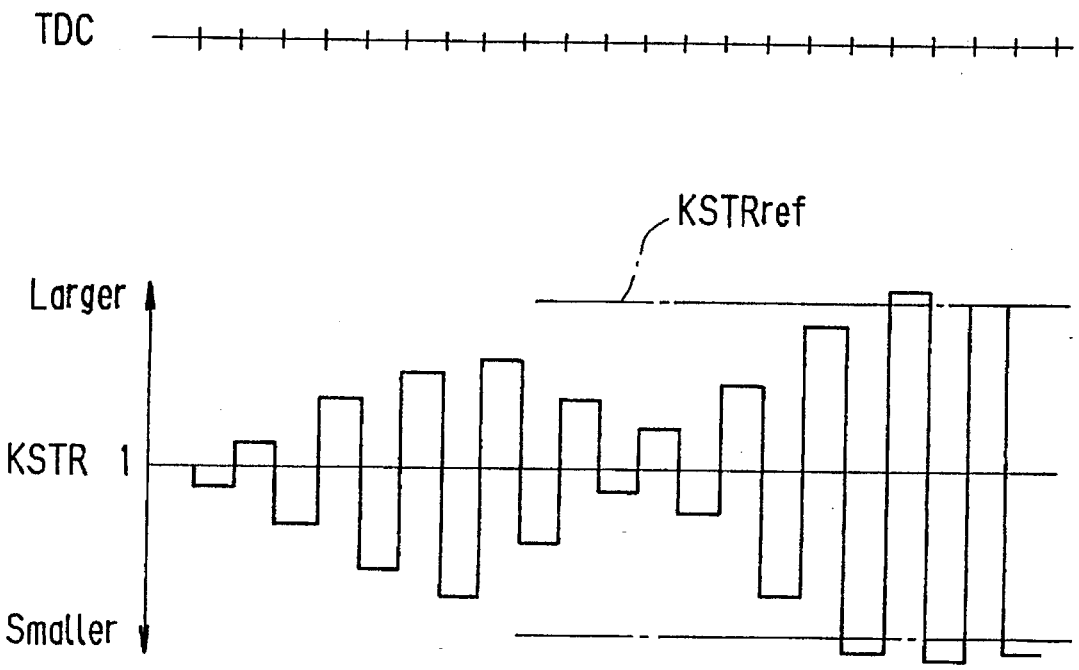
FIG. 8 is a timing chart showing a threshold value to be compared with the absolute value of the feedback correction coefficient in the procedures shown in FIG. 6.

This is in part related to what was said earlier regarding the fourth object of the invention. Wild fluctuation of the feedback correction coefficient causes sudden changes in the controlled variable and degrades control stability. The absolute value of the difference between 1.0 and the feedback correction coefficient is therefore compared with a threshold value and if it exceeds the threshold value a new feedback correction coefficient is determined based on PID control in S104 and the following steps. As a result, the controlled variable does not change suddenly and stable control can be realized. Here, it is alternatively possible to compare the coefficient, instead of the absolute value, with two threshold values by the magnitude making 1.0 as its center. This is illustrated in FIG. 8.

If S124 finds that the absolute value of the difference between 1.0 and the calculated feedback correction coefficient KSTR(k) does not exceed the threshold value, the value determined by the STR controller is set as the feedback correction coefficient KFB in S126. If the result in S122 is NO, the bit of the flag FKSTR is reset to 0 in S128 and the value determined by the PID controller is set as the feedback correction coefficient KFB in S130.

Next, in S28 of the routine of FIG. 4, the quantity of fuel injection Tim is multiplied by either of the calculated feedback correction coefficient KFB, etc., and the addition term TTOTAL is added to the result to obtain the output quantity of fuel injection Tout. The output quantity of fuel injection Tout is then output to the injector 22 via the drive circuit 72 as the manipulated variable in S30.

If S12 finds that the engine is cranking, the output quantity of fuel injection Tout is calculated retrieving the quantity of fuel injection Ticr in S34 and using the value in accordance with a start mode equation in S36. If S14 finds that fuel cutoff has been effected, the output quantity of fuel injection Tout is set to 0 in S38. Since open-loop control goes into effect if the result is NO in either of S18 or S20, in these cases the value of the feedback correction coefficient KFB is set to 1.0 in S32 and the output quantity of fuel injection Tout is calculated in S28. Open-loop control is also implemented when the result in either of S12 or S14 is YES, as just mentioned.

In this embodiment, when open-loop control is discontinued and feedback control is resumed, as in the case where the supply of fuel is resumed after once being cut off, the feedback correction coefficient is determined based on PID control law for a predetermined period. As a result, the feedback correction coefficient determined by the STR controller is not used during periods when the difference between the detected air/fuel ratio and the true air/fuel ratio is large owing to the time required for the supplied fuel to be combusted and to the detection delay of the sensor itself. The controlled variable (detected value) therefore does not become unstable and degrade the stability of the control.

On the other hand, since a predetermined value is set during this period, the control convergence can be improved after the detected value has stabilized by using the adaptive correction coefficient determined by the STR controller for operating the system so as to absorb the control error all at one time. A particularly notable feature of the embodiment is that an optimal balance is achieved between control stability and control convergence owing to the fact that the control convergence is improved by determining the manipulated variable as the product of the feedback correction coefficient and the manipulated variable.

When fluctuation of the desired air/fuel ratio is large, moreover, the feedback correction coefficient is determined based on PID control even after the passage of the predetermined period so that an optimal balance between control stability and convergence is achieved when feedback control is resumed following open loop control as at the time of discontinuing fuel cutoff, full-load enrichment or the like.

Since the feedback control coefficient is determined by PID control law when the adaptive control coefficient determined by the STR controller becomes unstable, moreover, an even better balance between control stability and convergence is achieved.

Further, in switching from STR control to PID control the I term of KLAF is calculated using the feedback correction coefficient determined by the STR controller, while in resuming STR control following PID control a time at which the detected value KACT is 1 or near one is selected and the initial value of the feedback correction coefficient by the adaptive control law (STR controller) is set approximately equal to the PID correction coefficient by PID control law. In other words, the system ensures smooth transition back and forth between PID control and adaptive control. Since the manipulated variable therefore does not change suddenly, the controlled variable does not become unstable.

In addition, since the feedback correction coefficient is determined based on the PID control law during engine idling, no conflict occurs between the fuel metering feedback control and the intake air quantity control conducted during engine idling.

While the first embodiment was explained as including Sl10, Sl14 and S124 in the subroutine of FIG. 6, any or all of these can be omitted. Similarly, any or all of S208 (S210), S212 and S216 in the subroutine of FIG. 7 can also be omitted.

Figure 9:
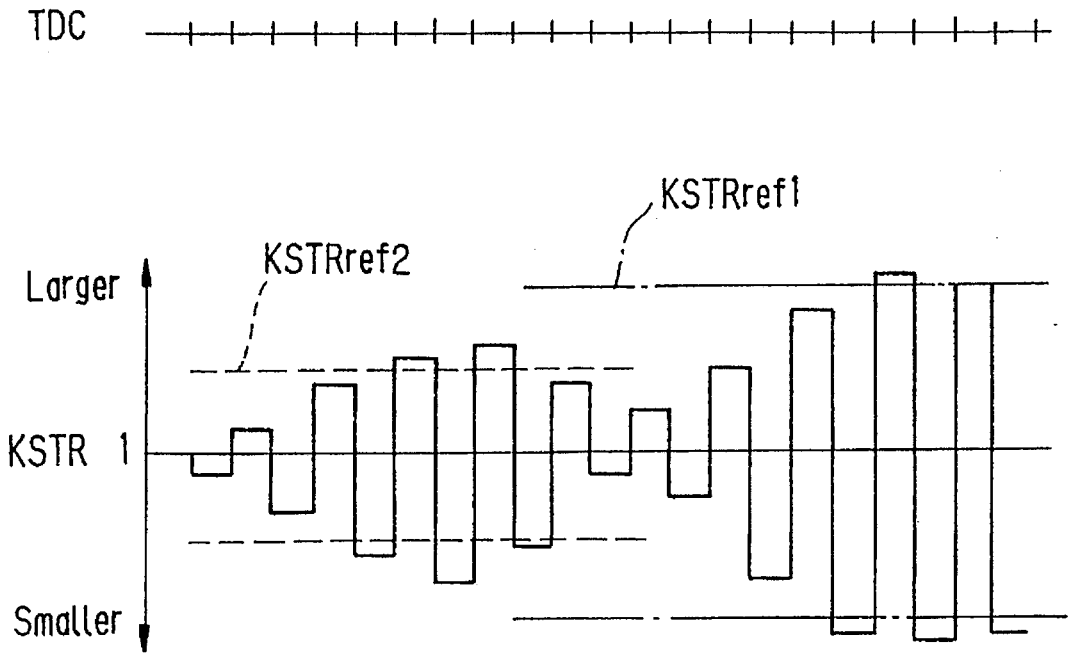
FIG. 9 is a timing chart, similar to FIG. 8, but showing a second embodiment of the invention.

A second embodiment of the invention is shown in FIG. 9, which is a timing chart similar to that of FIG. 8 relating to the first embodiment. In the case of the second embodiment, a second threshold value KSTRref2 is provided in addition a first threshold value KSTRref1 corresponding to the threshold value KSTRref (renamed as KSTRref1) used in the first embodiment.

The absolute value of the adaptive correction coefficient KSTR(k) is compared with the first and second threshold values KSTRref1 and KSTRref2 and if the absolute value thereof exceeds the second threshold value KSTRref2 for a prescribed period, the adaptive correction coefficient KSTR is reset to its initial value. Specifically, it is reset to 1 and the feedback correction coefficient is calculated by the STR controller. If the absolute value thereof exceeds the first threshold value KSTRrefl for a prescribed period, it is considered that fluctuation has occurred and the feedback correction coefficient is obtained from the PID controller rather than the STR controller. Resetting to the initial value and determination of the feedback correction coefficient by the PID control law are discontinued when fuel cutoff is implemented or the feedback control is left.

With the arrangement, it is possible to determine the feedback correction coefficient more appropriately, thereby enhancing the control stability further.

Figure 10:
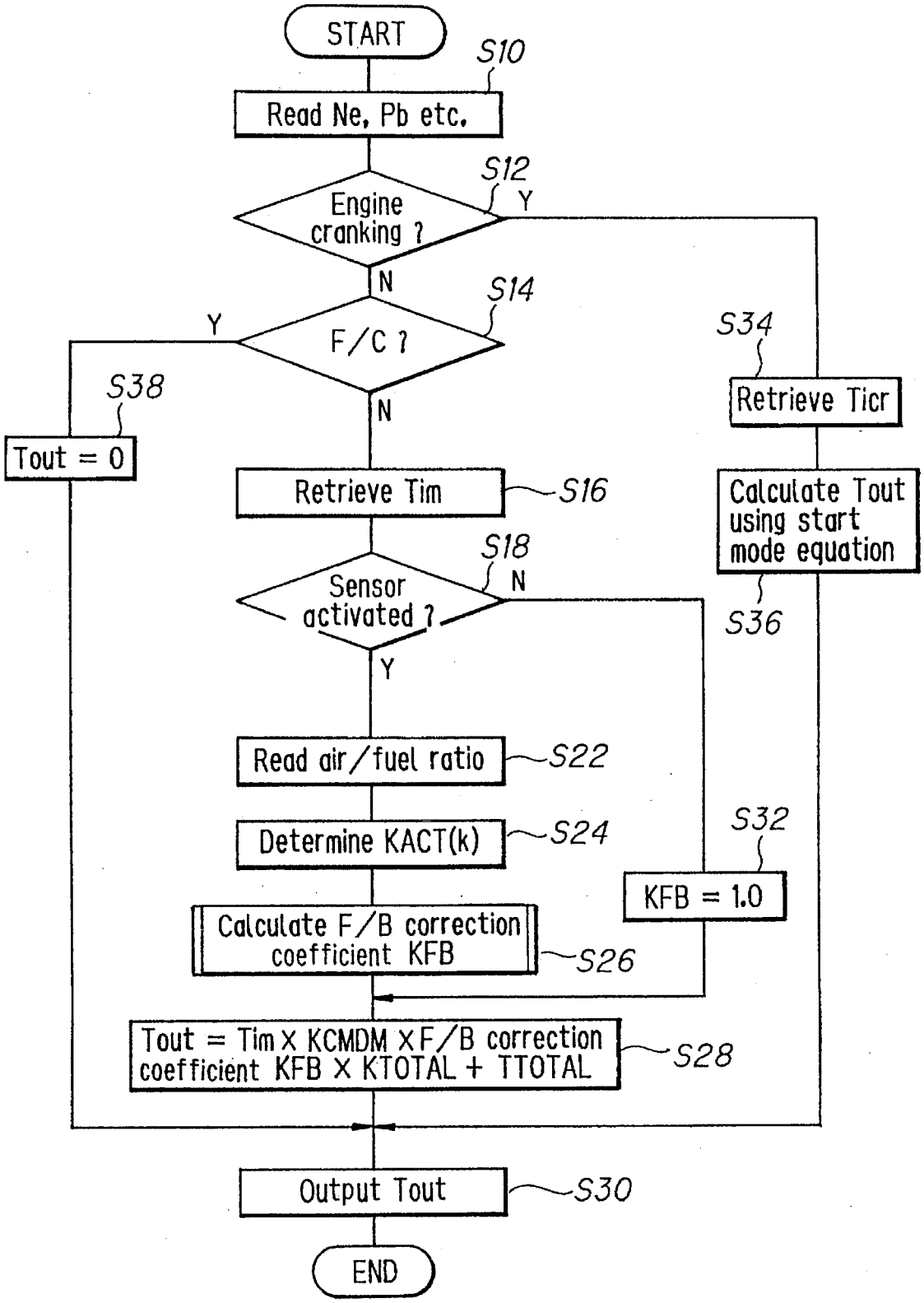
FIG. 10 is a flowchart, similar to FIG. 4, but showing a third embodiment of the invention.

FIG. 10 is a flowchart, similar to FIG. 4, but showing a third embodiment of the invention.

Explaining this while focusing on the difference from the first embodiment, the program begins at S10 and proceeds up to S18 similar as in the first embodiment. If the result in S18 is affirmative, it immediately goes to S22 to read the output of the LAF sensor 54. In other words, S20 concerning the feedback control region checking is replaced by a subroutine flowchart for the FB calculation.

Figure 11:
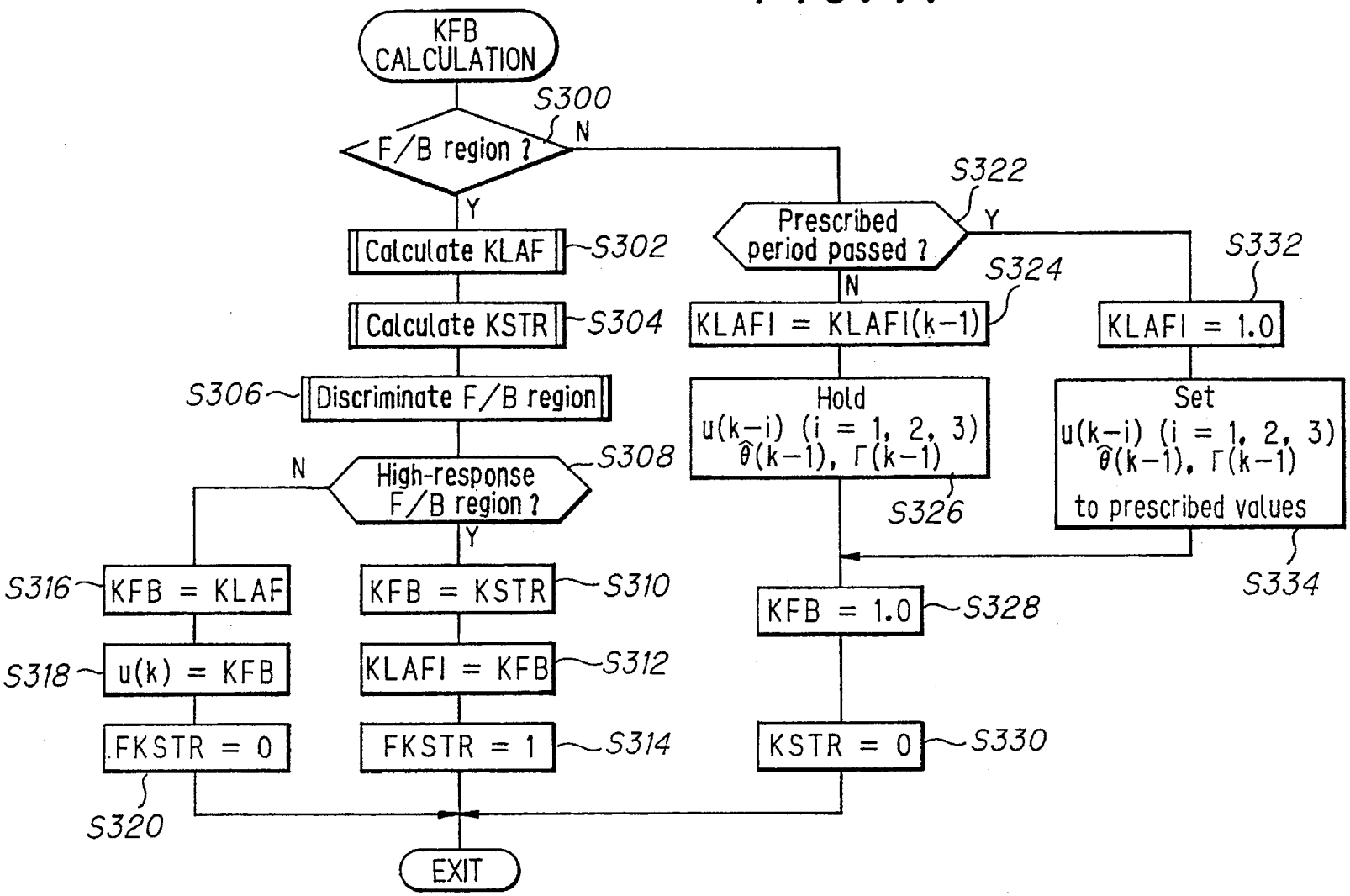
FIG. 11 is a subroutine flowchart of FIG. 10 showing the calculation of the feedback correction coefficient KFB according to the third embodiment.

The subroutine for this is shown by the flowchart of FIG. 11.

The program begins at S300 in which it is discriminated whether the engine operating condition is in a feedback control region. This is done in the same manner as the first embodiment.

If the result in S300 is YES, the program proceeds to S302 in which the PID correction coefficient KLAF is calculated in the same manner as the first embodiment, and to S304 in which the adaptive correction coefficient KSTR is calculated in the same manner as the first embodiment.

Here, the relationship between the calculations will be explained.

Calculations are carried out in parallel in the STR controller and the PID controller. Specifically, the adaptation mechanism indicated by Eqs. 5 to 7 is input with intermediate variables zeta (k–d), namely, with a vector lumping together the current and past control values u(k)(KSTR(k)) and y(k)(KACT(k)), and calculates the controller parameters $\hat{\theta}(k)$ from the cause and effect relationship therebetween.

u(k) used here is the aforesaid feedback correction coefficient used in the fuel injection quantity calculation. Under a condition where PID control is to be conducted instead of adaptive control in the next control cycle, the PID correction coefficient KLAF is used as the feedback correction coefficient. While conducting PID control, even if the input u(k) to the adaptation mechanism is changed from the adaptive correction coefficient KSTR(k) to KLAF(k), since the plant output (controlled variable) generated in accordance with the feedback correction coefficient and used for fuel metering control, namely KACT(k+d'), is output and since the cause-effect relationship is therefore established between the input and output, the adaptation mechanism can calculate the controller parameter vector $\hat{\theta}(k)$ without divergence. Thus, when $\hat{\theta}(k)$ is input to Eq. 9, KSTR(k) is calculated. At this time, the replacement KSTR(k–i)=KLAF(k–i) is permissible in the calculation of KSTR(k) (i=1, 2, 3).

Thus, the adaptive correction coefficient KSTR can be calculated even when the PID controller is operating and it has been confirmed that the PID correction coefficient KLAF and the adaptive correction coefficient KSTR are substantially identical at any particular time. Since the values of the PID correction coefficient KLAF and the adaptive correction coefficient KSTR are close, moreover, the switch between them is smooth.

Returning to the explanation of the FIG. 11 flowchart, the program moves to S306 in which it is discriminated as to whether the operating region is one in which the feedback control is to be conducted using the high-control-response feedback correction coefficient (adaptive correction coefficient KSTR) or using the low-control-response feedback correction coefficient (PID correction coefficient KLAF).

Figure 12:
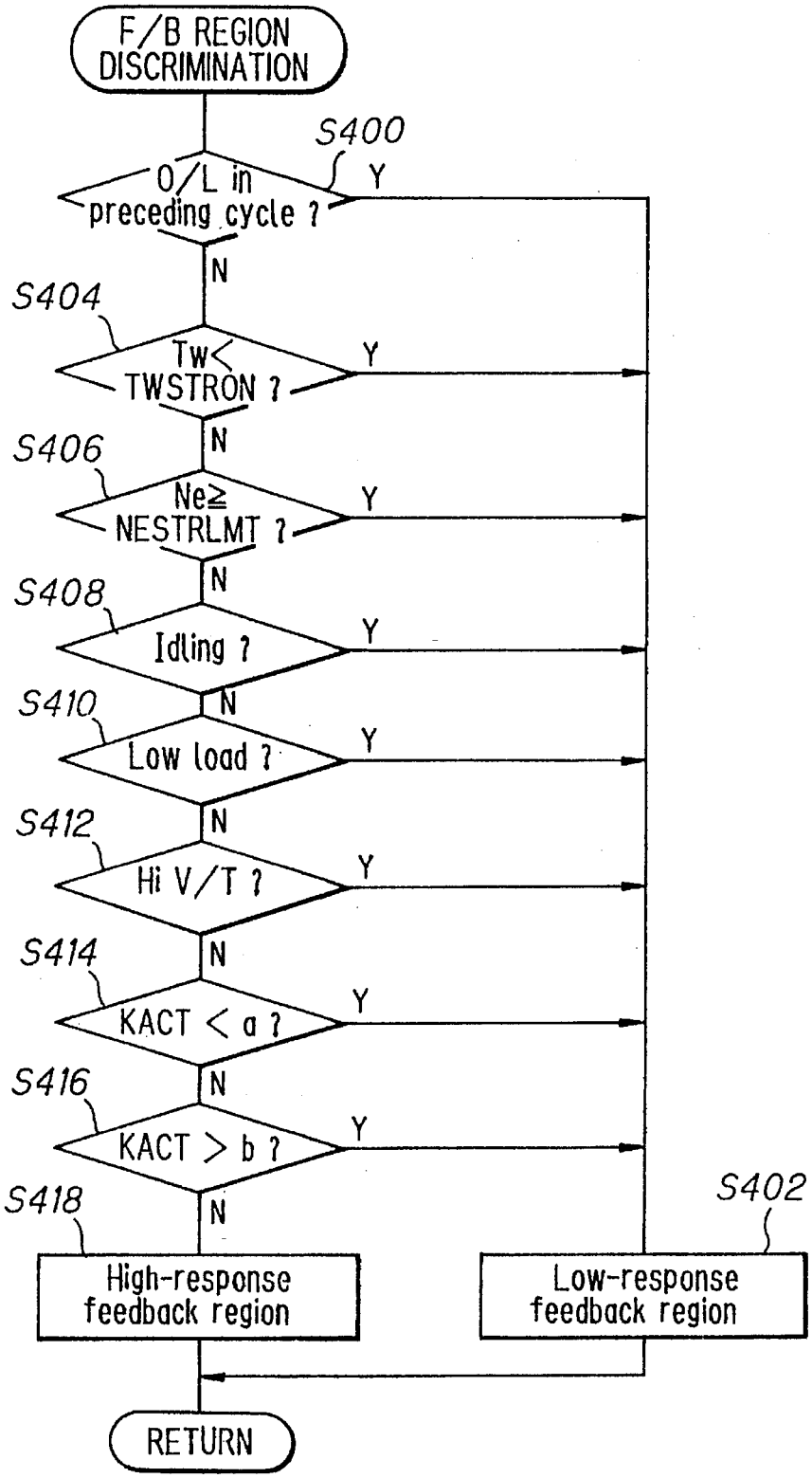
FIG. 12 is a subroutine flowchart of FIG. 11 for discriminating the feedback control region.

FIG. 12 is the flowchart of a subroutine for this region discrimination.

First, in S400, it is checked whether open-loop control was in effect at the preceding control cycle, i.e., at the time the subroutine of FIG. 10 was activated in the preceding control cycle. If the result is YES, the program goes to S402 in which the region is determined to be one in which feedback control is to be conducted using the low-control-response feedback correction coefficient (PID correction coefficient KLAF) (hereinafter referred to as the "low-response feedback region"). This is because, for the reason explained earlier, it is preferable not to conduct high-response feedback control immediately after returning from open-loop control. In changing from open-loop control to feedback control it is possible to conduct low-response feedback control for a prescribed period (5 TDCs, for example). In such a case, it suffices to provide a discrimination step after S400 for continuously directing the program to S402 during the prescribed period.

If the result in S400 is NO, the program goes to S404 in which it is checked whether the engine coolant temperature Tw is less than a prescribed value TWSTRON. The prescribed value TWSTRON is set at a relatively low coolant temperature and if the detected engine coolant temperature TW is below the prescribed value TWSTRON, the program proceeds to S402 in which the engine operating condition is determined to be in the low-response feedback region. The reason for this is that the combustion is unstable at low coolant temperatures, making it impossible to obtain a stable detection of the value KACT owing to misfiring and the like. Although not shown in FIG. 12, for the same reason, the operating condition is also determined to be in the low-response feedback region when the coolant temperature is abnormally high.

If S404 finds that the engine coolant temperature TW is not lower than the prescribed value TWSTRON, the program advances to S406 in which it is checked whether the detected engine speed Ne is at or above a prescribed value NESTRLMT. The prescribed value NESTRLMT is set at a relatively high engine.speed. If S406 finds that the detected engine speed Ne is at or above the prescribed value NESTRLMT, the program goes to S402 in which the operating condition is determined to be in the low-response feedback region. This is because during high-speed engine operation there tends to be insufficient time for calculation and, moreover, combustion is unstable.

If S406 finds that the detected engine speed Ne is lower than the prescribed value NESTRLMT, the program proceeds to S408 in which it is checked whether the engine is idling. If the result is YES, the program goes to S402 in which the operating condition is determined to be in the low-response feedback region. This is because the generally stable operating condition during idling obviates the need for a high gain such as that according to the adaptive control law.

If S408 finds that the engine is not idling, the program proceeds to S410 in which it is judged whether the engine load is. If the result is YES, the program goes to S402 in which the operating condition is determined to be in the low-response feedback region. This is because combustion is not stable in the low engine load region.

If S410 finds that the engine load is not low, the program proceeds to S412 in which a check is made whether HiV/T (high-engine-speed side valve timing) is selected in the variable valve timing mechanism. If so, the program proceeds to S402 in which the operating condition is determined to be in the low-response feedback region. This is because the large amount of valve timing overlap present when the high-engine-speed side valve timing characteristic is selected is apt to cause intake air blowby (escape of intake air through the exhaust valve), in which case the detected value KACT is not likely to be stable. In addition, the detection delay of the LAF sensor cannot be ignored during high-speed operation.

The decision as to whether or not high-speed side valve timing is selected is made not only based on whether or not high-speed valve timing has actually been selected but also with reference to an appropriate flag indicating whether or not a command to switch the valve timing characteristics from the low-speed side to the high-speed side has been issued in a control unit (not shown) of the variable valve timing mechanism. This is because changes in valve timing characteristics may not be implemented at all cylinders simultaneously. During transient states and the like, therefore, cases may occur in which the valve timing characteristic temporarily differs between different cylinders. In other words, in switching the valve timing characteristic to the high-speed side, it is arranged so that the switch to the high-speed side is conducted in the control unit of the variable valve timing mechanism after confirmation that feedback control using the PID correction coefficient is in effect as a result of a discrimination that the engine operating condition is in the low-response feedback region.

If the result in S412 is NO, the program goes to S414 in which it is checked whether the detected air/fuel ratio KACT is below the lower limit a. If the result is YES, the program goes to S402. If NO, it goes to S416 in which a check is made as to whether the detected value KACT is greater than the upper limit b. If the result is YES, the program goes to S402. If NO, it goes to S418 in which the operating condition is determined to be in a region in which feedback control is to be conducted using a high-control-response feedback correction coefficient (adaptive feedback correction coefficient KSTR) (hereinafter referred to as the "high-response feedback region"). As referred to briefly, the values a and b are appropriately set for enabling discrimination of lean and rich air/fuel ratios since it is better to avoid high-response control such as adaptive control when the air/fuel ratio is lean or rich. In making the discrimination, the desired air/fuel ratio can be used in place of the detected air/fuel ratio for comparison with the prescribed values.

Returning to the subroutine of FIG. 11, it is then checked in S308 whether the region is determined to be the high-control-response feedback region. If the result is YES, the feedback correction coefficient KFB is set to the feedback correction coefficient KSTR in S310, whereafter the I term KLAFI is set to or replaced with the feedback correction coefficient KFB in S312. The reason for this is that, as mentioned before, the I term (integral term) may change suddenly when the adaptive correction coefficient KSTR is switched to the PID correction coefficient KLAF in the next control cycle. By determining the initial value of the I term of the PID correction coefficient KLAF using the value of the adaptive correction coefficient KSTR in this way, the difference in level between the adaptive correction coefficient and the PID correction coefficient can be reduced to prevent sudden change in the controlled variable and ensure stable control. Next, in S314, the bit of a flag FKSTR is set to 1 to indicate that the quantity of fuel injection is corrected using the adaptive correction coefficient KSTR.

On the other hand, if S308 finds that the operating condition is not in the high-response region, the feedback correction coefficient KFB is set to the PID correction coefficient KLAF in S316 and the plant input u(k) is set to the feedback correction coefficient KFB in S318 (which will be input to the STR controller as shown in FIG. 5). This is because even outside the STR control region the STR controller continues to operate using the PID correction coefficient KLAF. The bit of the flag FKSTR is then reset to 0 in S320.

If S300 finds that the operating condition is not in the feedback region, the program goes to S322 in which a check is made as to whether or not a prescribed period, or time, has passed since leaving the feedback region. If the result is NO, the program goes to S324 where the value of KLAF in the current control cycle is set to or replaced with KLAFI(k−1), the value of the I term in the preceding control cycle, which is to say that the I term is held. Next, in S326, the internal variables (intermediate variables) of the adaptive controller are similarly held at the preceding value, i.e., the final value during adaptive control.

This is because, as shown in FIG. 5, the calculation of zeta(k) uses the plant input u, not only the control input u(k) at the current control cycle but also u(k−1) and other past values in preceding control cycles. Therefore, i of u(k−i) in S326 is a comprehensive symbol encompassing the current and past control values. The procedure at S326 thus means that u(k), u(k−1), u(k−2) and u(k−3), more precisely, u(k−1), u(k−2), u(k−3) and u(k−4) are held. The controller parameters $\hat{\theta}$ and the gain matrix $\Gamma$ are simply held at their preceding values. In a case such as when the controller parameters (controller parameter vector) $\hat{\theta}$ and the gain matrix $\Gamma$ are stored in memory as mapped values, the map value can be used in place of the held value. Further, though not shown in the drawings, KSTR and KACT are also held at the final values in adaptive control. KACT and input u(k−i) can of course be lumped together and held as zeta.

Next, in S328, the value of the feedback correction coefficient KFB is set to 1.0, which is to say that feedback control is not conducted. The bit of the flag FKSTR is then reset to 0 in S330.

On the other hand, if S322 finds that the prescribed period has passed since leaving the feedback region, the value of the I term KLAFI is set to 1.0 (initial value) in S332, whereafter the plant input u, the controller parameters $\hat{\theta}$ and the gain matrix $\Gamma$ are set to prescribed values, e.g., their initial values in S334. The plant input u is specifically set to u(k)=u(k−1)=u(k−3)=1.

This is related to a frequently encountered situation. Namely, shortly after the accelerator pedal has once been released, fuel cutoff effected and open-loop control implemented, it often happens that the accelerator pedal is soon depressed again, causing the engine to accelerate and feedback control to be resumed. When feedback control is resumed after only a short time in this way, almost no change arises in the operating condition of the engine between before and after the non-operating region of the STR controller and, therefore, the cause-effect relationship with the combustion history naturally holds.

In the case of a transitory region of this kind, therefore, holding the internal variables of the adaptive controller improves the control stability by maintaining the continuity of the adaptive control and enabling the adaptive control to be conducted without unnecessarily returning to the initial state. In this sense, the prescribed period referred to regarding S322 defines a time range during which the cause-effect relationship with the combustion history continues to hold. The term "period" used here is defined to include both intervals measured in time and intervals measured in control (program) cycles (number of combustion cycles, TDCs etc.).

When the prescribed period or longer has passed, on the other hand, it can be assumed that a large change has occurred in the operating state of the engine between before and after the non-operating region of the STR controller. In this case, therefore, the internal variables are returned to prescribed values, for instance, their initial values, in S334. The initial values of $\hat{\theta}$(k−1) and u(k) (=KSTR(k)) can be stored in memory for each operating region of the internal combustion engine and the stored values can be used as the past values of $\hat{\theta}$(k−1) and zeta (k−d). This further improves the controllability at resumption of adaptive control. In addition, $\hat{\theta}$(k) can be learned for each operating region.

Next, in S28 of the routine of FIG. 10, the output quantity of fuel injection is determined in the manner described earlier and is output in S30.

In this embodiment, when open-loop control of the fuel metering and air/fuel ratio is discontinued and feedback control is resumed, as in the case where the supply of fuel is resumed after once being cut off, the feedback correction coefficient is determined based on the PID control law for a prescribed period, similar to the first embodiment. As a result, the feedback correction coefficient of high control response determined by the adaptive control law is not used during periods when the difference between the true air/fuel ratio and the detected air/fuel ratio is large owing to the time required for the supplied fuel to be combusted and to the detection delay of the sensor itself. The controlled variable therefore does not become unstable and degrade the stability of the control.

On the other hand, the convergence speed can be improved after the detected value has stabilized by using the feedback correction coefficient of high control response determined by the adaptive control law for operating the system so as to absorb the control error all at one time. A particularly notable feature of the embodiment is that an optimal balance is achieved between control stability and control convergence owing to the fact that the control convergence is improved by determining the manipulated variable as the product of the feedback correction coefficient and the basic value.

In addition, since the STR controller and the PID controller are operated in parallel while mutually replacing the internal variables so as to calculate the adaptive correction coefficient KSTR and the PID correction coefficient KLAF in parallel, the transition from the adaptive correction coefficient KSTR to the PID correction coefficient KLAF and vice versa can be smoothly conducted. Further, the fact that switching between the two types of correction coefficients can be conducted with desired timing makes it possible to achieve optimum switching, while the fact that the switching can be conducted without producing spikes in the air/fuel ratio results in improved fuel metering and air/fuel ratio controllability.

Figure 13:
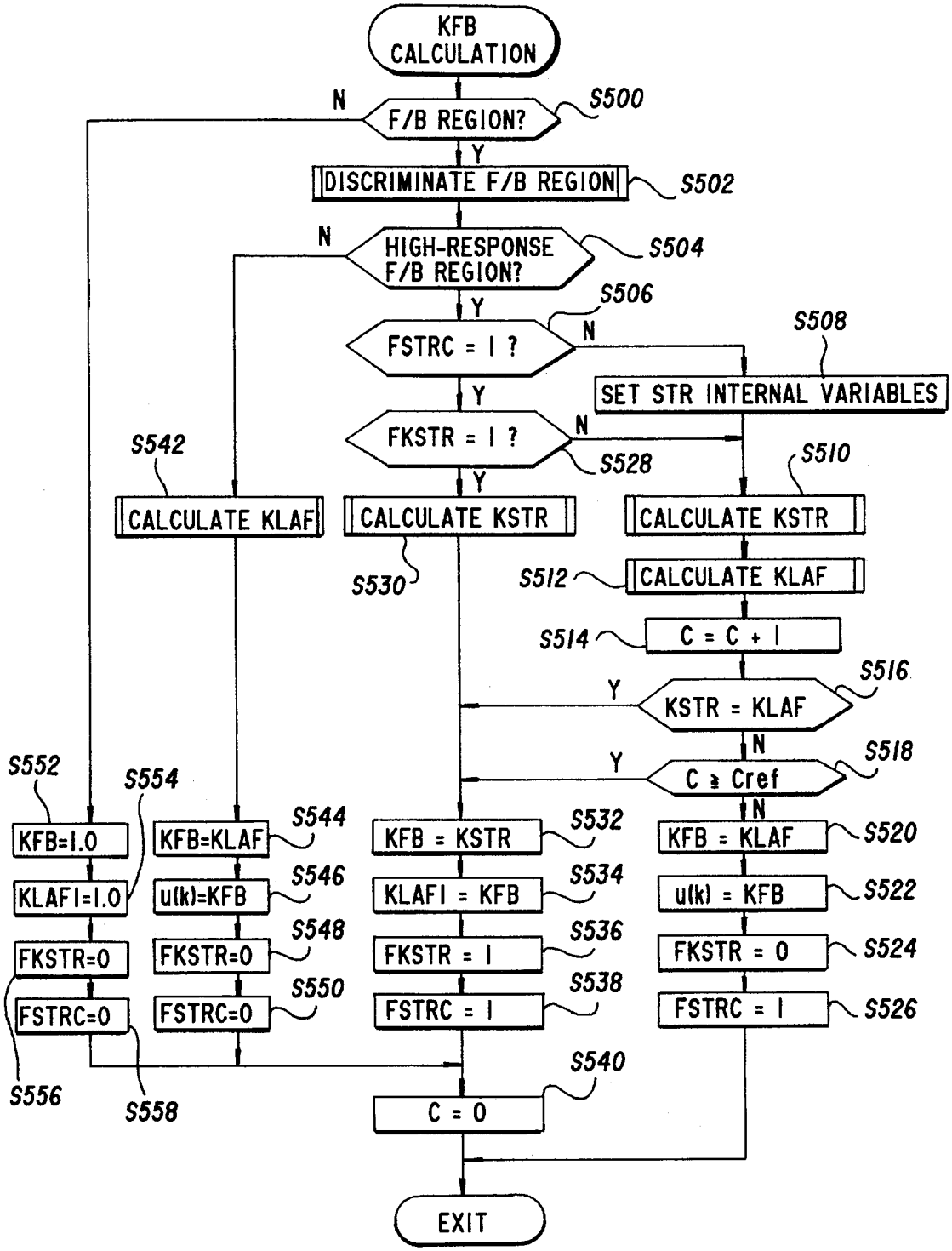
FIG. 13 is a flowchart, similar to FIG. 11, but showing a fourth embodiment of the invention.

FIG. 13 shows a fourth embodiment of the invention, specifically a subroutine similar to that of FIG. 11 for calculating the feedback correction coefficient KFB.

In the fourth embodiment, the processing or calculation load is reduced by having the STR controller and the PID controller conduct parallel calculations only during transitions from the low-response feedback region to the high-response feedback region.

While the PID controller and the STR controller are both constantly maintained in operation for conducting calculations in the first embodiment, substantially the same effect can be obtained even if the STR controller is stopped and the adaptive correction coefficient KSTR is not calculated when the PID controller is in operation. In fact, an even greater effect can be obtained from the aspect of reducing the processing load.

As is clear from Eqs. 5 to 7, past values (values at the past control cycles) of the internal or intermediate variables are required for calculating the controller parameters $\hat{\theta}(k)$. The converse of this is that the controller parameters $\hat{\theta}(k)$ can be calculated insofar as the past values of the internal or intermediate variables are available. The past values of the internal or intermediate variables necessary for calculation include $\hat{\theta}(k-1)$, zeta (k–d) and $\Gamma(k-1)$. As in the third embodiment, zeta (k–d) can be generated by alternating between the PID correction coefficient KLAF and the adaptive correction coefficient KSTR.

Further, since $\Gamma(k-1)$ is the gain matrix determining the estimation/identification speed, a prescribed value such as the initial value can be used therefor. When $\hat{\theta}$ is held such that KSTR is 1.0 (initial value) or thereabout, it is preferable to divide $b_0$ by KLAF(k–1), since the value KSTR(k) calculated by Eq. 6 becomes KLAF(k–1), as explained earlier.

The subroutine of FIG. 13 will now be explained based on the foregoing assumptions. First, in S500, it is checked whether the operating condition is in the feedback control region. If the result is YES, the feedback region is discriminated in S502. The procedure for this is the same as that according to the subroutine of FIG. 12 in the third embodiment. Then it is checked in S504 whether the operating condition is in the high-response feedback region. If the result is YES, it is checked in S506 whether the bit of a flag FSTRC is set to 1.

Immediately following return to the high-response feedback region from the low-response feedback region, for example, the result in S506 is NO and the internal variables of the adaptive controller are set in S508. This is carried out in the manner explained earlier regarding S334 of the subroutine of FIG. 11. Next, in S510, the adaptive correction coefficient KSTR is calculated by processing like that explained earlier regarding the first embodiment, whereafter the PID correction coefficient KLAF is calculated in S512 by processing like that explained earlier regarding the first embodiment.

Next, in S514, the value of a counter C is incremented and then it is checked in S516 whether the adaptive correction coefficient KSTR and the PID correction coefficient KLAF are approximately (or exactly) the same. If the result is NO, it is checked in S518 whether the counter value C exceeds a prescribed value Cref. If the result in S518 is NO, the feedback correction coefficient KFB is set to the PID correction coefficient KLAF in S520, whereafter the plant input u(k) is set to the feedback correction coefficient KFB in S522. The bit of the flag FKSTR is then reset to 0 in S524 and the bit of a flag FSTRC is set to 1 in S526.

In the next program loop (control cycle), therefore, the result in S506 is YES and the result in S528 is NO, so that the program moves through S510 and the following steps and repeats the aforesaid processing until the result in S516 or S518 becomes YES. In other words, the adaptive correction coefficient KSTR and the PID correction coefficient KLAF are calculated in parallel during this period in S510 and S512.

Then, when the result in S516 or S518 becomes YES after a certain number of program loops, the feedback correction coefficient KFB is set to the adaptive correction coefficient KSTR in S532 and, for the reason explained earlier, the I term KLAFI is replaced with feedback correction coefficient KFB in S534, whereafter the bit of the flag FKSTR is set to 1 in S536, the bit of the flag FSTRC is set to 1 in S538, and the value of counter C is reset to 0 in S540. At the start of the next program loop, therefore, the result in S506 is YES, the result in S528 is also YES, and the adaptive correction coefficient KSTR is calculated in S530 using the same procedures as in the first embodiment.

On the other hand, if S504 finds that the operating condition is not in the high-response feedback region, the PID correction coefficient KLAF is calculated in S542 using the same procedures as in the first embodiment, the feedback correction coefficient KFB is set to the PID correction coefficient KLAF in S544, the plant input u(k) is set to the feedback correction coefficient KFB in S546, the bit of the flag FKSTR is reset to 0 in S548, and the bit of the flag FSTRC is set to 0 in S550.

When feedback control is resumed after open-loop control, therefore, the operating condition is first found to be in the low-response feedback region, parallel calculation of the adaptive correction coefficient KSTR and the PID correction coefficient KLAF is conducted only temporarily upon return to the high-response feedback region from the low-response feedback region, and only the adaptive correction coefficient KSTR is calculated after the values of the two coefficients have become substantially the same or after the passage of a prescribed number of control cycles (Cref).

If S500 finds that the operating condition is not in the feedback control region, the value of the feedback back correction coefficient KFB is set to 1.0 in S552, the value of the I term KLAFI is set to 1.0 in S554, the bit of the flag FKSTR is reset to 0 in S556, and the bit of the flag FSTRC is also reset to 0 in S558.

In the fourth embodiment, parallel calculation of the adaptive correction coefficient KSTR and the PID correction coefficient KLAF is conducted only temporarily upon return to the high-response feedback region from the low-response feedback region and only the adaptive correction coefficient KSTR is calculated after the values of the two coefficients have become substantially the same or after the passage of a prescribed number of control cycles. As a result, it is possible to realize both smooth switching and a reduction in the processing load.

Alternatively, after the issuance of a command to switch from the PID correction coefficient KLAF to the adaptive correction coefficient KSTR, it is possible to calculate only the adaptive correction coefficient KSTR using the aforesaid zeta(k–d), $\Gamma(k-1)$ and $\hat{\theta}(k)$ during the prescribed number of control cycles. In other words, complete switchover to the adaptive correction coefficient KSTR can be effected after the quantity of fuel injection has been corrected using the PID correction coefficient KLAF during the prescribed number of cycles.

Moreover, instead of making the switch from KLAF(k) to KSTR(k) after the prescribed number of control cycles, it is possible to switch from KLAF(k) to KSTR(k), when KSTR(k) falls within a range defined as $KLAF(k)-\alpha \leqq KSTR(k) \leqq KLAF(k)-\beta$ ($\alpha$, $\beta$: prescribed small values), namely after KSTR(k) becomes approximately equal to KLAF(k).

While it was explained that the feedback correction coefficient to be used for the injection quantity correction is switched from KLAF(k) to KSTR(k) when the result in S516 or S518 is YES, one or the other of S516 and S518 can be omitted.

Figure 14:
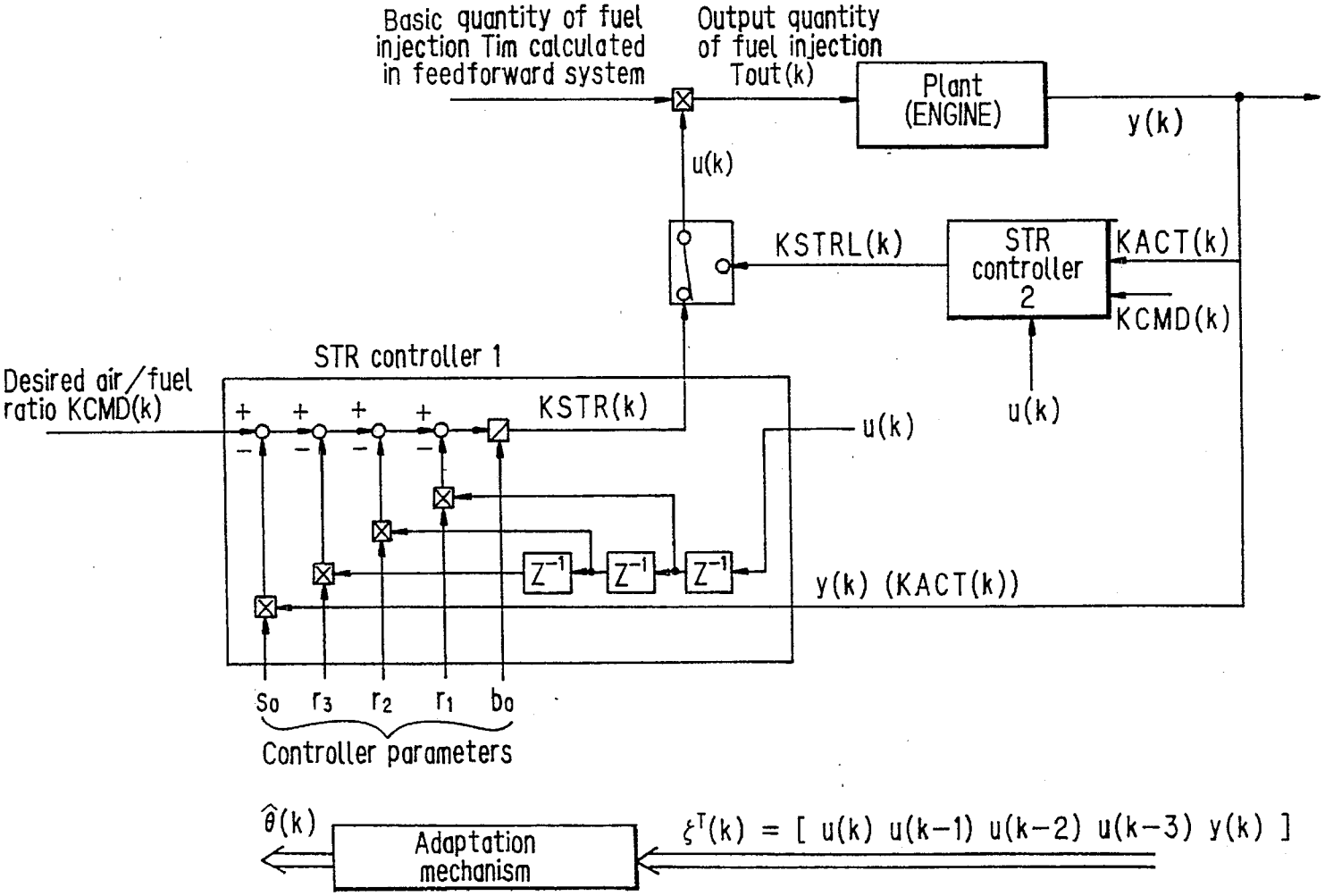
FIG. 14 is a block diagram, similar to FIG. 5, but showing a fifth embodiment of the invention.
Figure 15:
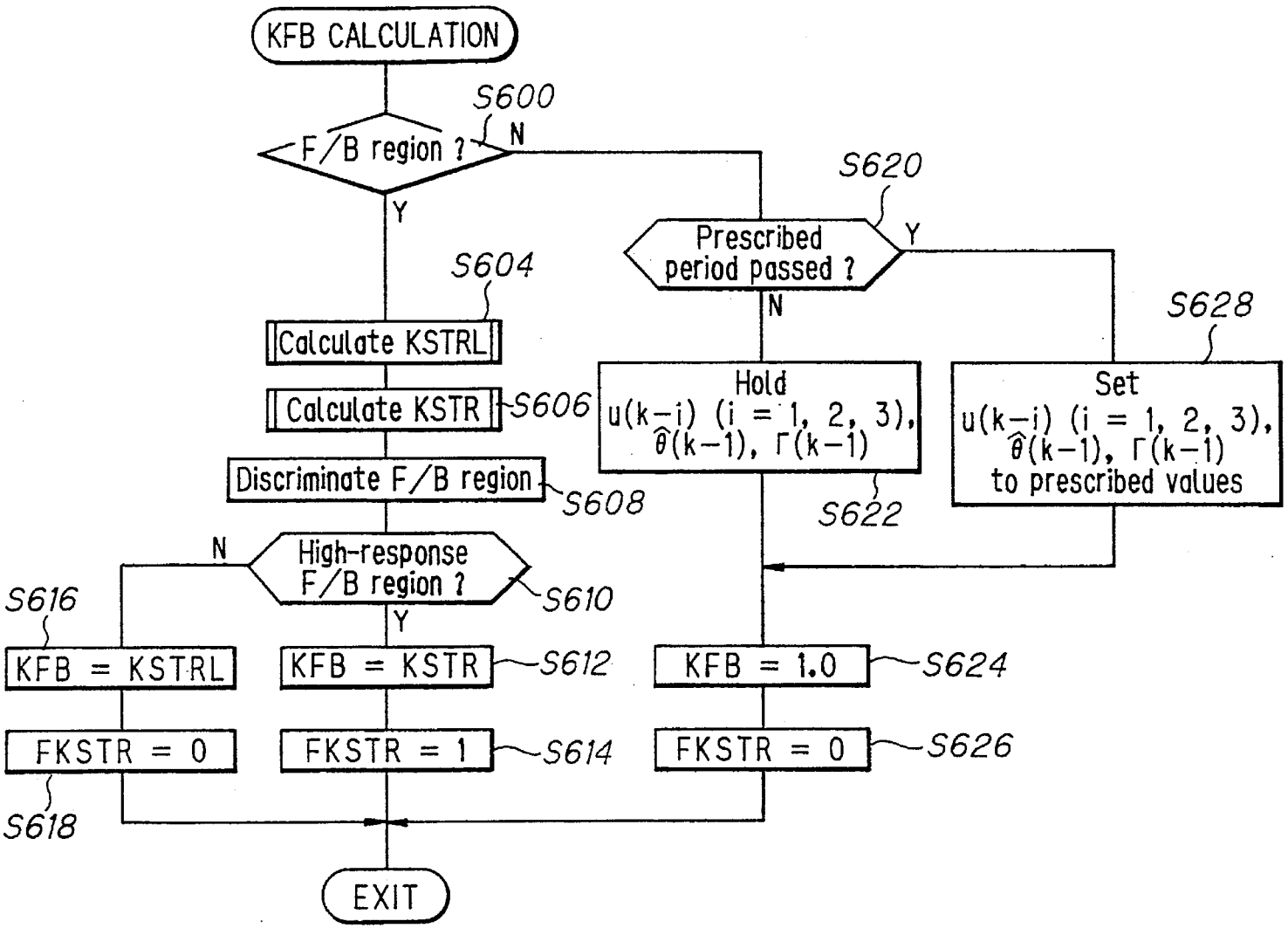
FIG. 15 is a flowchart showing the calculation of the feedback correction coefficient in the fifth embodiment.

FIG. 14 is a block diagram of a fifth embodiment of the invention and FIG. 15 is the flowchart of a subroutine for another method of calculating the feedback correction coefficient KFB in the fifth embodiment.

As shown in FIG. 14, the fifth embodiment has no PID controller but is provided with a second STR controller in addition to the STR controller of the first embodiment. (The STR controller corresponding to that in the first embodiment will be referred to as STR controller 1 and the second STR controller as STR controller 2.)

The relationship in control response between the feedback correction coefficient determined by the STR controller 1 (called the first adaptive correction coefficient KSTR) and the feedback correction coefficient determined by the STR controller 2 (called the second adaptive correction coefficient KSTRL) is defined as:

$$KSTR > KSTRL.$$

In other words, the gain of the second feedback correction coefficient KSTRL determined by the STR controller 2 is smaller and its control response is therefore lower.

The higher/lower gains (response) of the STR controllers 1 and 2 are achieved by using different algorithms, namely, the variable-gain algorithm and the constant-gain algorithm. More specifically, the STR controller 1 uses the variable-gain algorithm to enhance convergence speed while the STR controller 2 uses the constant-gain algorithm to set the aforementioned gain matrix $\Gamma$ to a lower gain, thus increasing stability. Instead, and more simply, it is possible to use the constant-gain algorithms in both controllers but make the gain matrix different. In this case it suffices to make:

Gain matrix $\Gamma$ of STR controller 1>Gain matrix $\Gamma$ of STR controller 2.

FIG. 15 is a subroutine flowchart showing the operation of the fifth embodiment. The subroutine according to FIG. 15 is similar to that of FIG. 11. Unless expressly stated otherwise, the steps of the subroutine of FIG. 15 conduct the same processing operations as the corresponding steps of FIG. 11.

First, in S600, it is discriminated whether the operating condition is in the feedback control region. If the result is YES, the adaptive correction coefficient KSTRL and the first adaptive correction coefficient KSTR are calculated in S604 and S606 by the same procedures as explained regarding the earlier embodiments, whereafter the type of feedback region is discriminated in S608 and it is checked in S610 whether the operating condition is in the high-response feedback region, and if the result is YES, the feedback correction coefficient KFB is set to the first adaptive correction coefficient KSTR in S612 and the bit of the flag FKSTR is set to 1 in S614. If S610 finds that the operating condition is not in the high-response feedback region, the feedback correction coefficient KFB is set to the second adaptive correction coefficient KSTRL in S616 and the bit of the flag FKSTR is reset to 0 in S618.

On the other hand, if S600 finds that the operating condition is not in the feedback region, then, similarly to the subroutine of the third embodiment shown in FIG. 11, it is checked in S620 whether the prescribed period has passed since leaving the feedback region. If the result is NO, then, similarly to the subroutine of the third embodiment shown in FIG. 11, the values of the internal variables are held at the values in the preceding control cycle in S622. The procedures with respect to the internal variables are conducted for both the first adaptive correction coefficient KSTR and the second adaptive correction coefficient KSTRL.

Next, in S624, the value of the feedback correction coefficient KFB is set to 1.0 and the bit of the flag FKSTR is then reset to 0 in S626. On the other hand, if the result in S620 is YES, the internal variables are set to prescribed values (the initial values) in S628. The values of the plant input $u(k-1)$, the controller parameters $\hat{\theta}(k-1)$ and the gain matrix $\Gamma(k-1)$ among the internal variables are set to different prescribed values in the first and second adaptive correction coefficients KSTR and KSTRL (although identical values can be used except for gain matrix $\Gamma(k-1)$).

Since, as described in the foregoing, the fifth embodiment is configured to calculate two feedback correction coefficients, different in control response, in parallel using two types of control laws, which are both adaptive control laws, and selects one or the other thereof based on the engine operating condition, effects like those of the third embodiment can be obtained. In this case also, as shown in S612, S614, S624, use of KFB actually used in the feedback control in the calculation of KSTR and KSTRL by the respective STR controllers enables constant correlation of the values of KSTR and KSTRL, thus reducing the difference in level at the time of switching.

While the fifth embodiment has been described as having two STR controllers, it is alternatively possible to use only one STR controller, use the constant-gain algorithm, and raise and lower the gain by changing the set value of $\Gamma$.

It is alternatively possible to have two STR controllers in the first and second embodiments so that when the absolute value of KSTR exceeds the first threshold value KSTRrefl, and to use the correction coefficient of a lower gain produced by the second controller.

While the absolute value of the difference between 1.0 and the adaptive correction coefficient KSTR has been calculated to be compared with the threshold value in the first and second embodiments, it is alternatively possible to compare the magnitude of KSTR with two threshold values with the center of 1.0. The threshold value may be different in the larger and smaller sides from 1.0.

While the period has been defined in terms of the number of TDC in the foregoing embodiments, it is alternatively possible to measure a time lapse, e.g., 100 ms using a timer.

While PID control has been taken as an example in the first to fourth embodiments, it is permissible instead to appropriately set the KP, KI and KD gains for conducting PI control and to control only the I term. In other words, the PID control referred to in the specification is established insofar as it includes some of the gain terms.

While the air/fuel ratio, more precisely the equivalence ratio, has been used as the desired value in the first to fifth embodiments, the quantity of fuel injection can instead be used as the desired value.

While the correction coefficients KSTR and KLAF(KSTRL) have been calculated as multiplication coefficients (terms) in the first to fifth embodiments, they can instead be calculated as addition terms.

While the throttle valve is operated by a stepping motor in the first to fifth embodiments, it can instead be mechanically linked with the accelerator pedal and be directly operated in response to accelerator pedal depression.

Moreover, while the first to fifth embodiments have been described with respect to examples using one or more STRs as the adaptive controller(s), one or more MRACS (model reference adaptive control systems) can be used instead.

While the invention has thus been shown and described with reference to the specific embodiments, it should be noted that the invention is in no way limited to the details of the described arrangements, changes and modifications may be made without departing from the scope of the appended claims.

What is claimed is:

1. A system for controlling fuel metering for an internal combustion engine, comprising:

air/fuel ratio detecting means for detecting an air/fuel ratio (KACT) of an exhaust gas of the engine;

engine operating condition detecting means for detecting an operating condition of the engine;

fuel injection quantity determining means for determining a quantity of fuel injection (Tim) to be supplied to the engine;

first feedback correction coefficient calculation means for calculating variables to determine a first feedback correction coefficient (KSTR) using a first control law having an algorithm expressed in a recursion formula;

second feedback correction coefficient calculation means for calculating variables to determine a second feedback correction coefficient (KLAF(KSTRL)), whose control response is inferior to that of the first feedback correction coefficient, using a second control law;

switching means for switching the first feedback correction coefficient (KSTR) and the second feedback correction coefficient (KLAF(KSTRL)) therebetween; and feedback control means for correcting a manipulated variable by the switched one of the feedback correction coefficients (KSTR, KLAF(KSTRL)) to bring at least one of the detected air/fuel ratio (KACT) and the quantity of fuel injection (Tim) to a desired value (KCMD);

wherein said switching means replacing at least one of the variables of one of the feedback correction coefficients (KSTR, KLAF(KSTRL)) with a value to be used in a calculation of the other of the feedback correction coefficients (KLAF(KSTRL), KSTR).

2. A system according to claim 1, wherein said switching means replaces at least one (bo) of the variables of the first feedback correction coefficient(KSTR) with the value (bo/KLAF) that includes the second feedback correction coefficient (KLAF(KSTRL)) such that the first feedback correction coefficient (KSTR(k)) becomes close to the second feedback correction coefficient (KLAF(KSTRL), when said switching means switches the feedback correction coefficient from the second (KLAF(KSTRL)) to the first (KSTR).

3. A system according to claim 2, wherein the value (bo/KLAF) includes the second feedback correction coefficient (KLAF(KSTRL)) calculated at a preceding control cycle.

4. A system according to claim 1, wherein said switching means replaces at least one (KLAFI) of the variables of the second feedback correction coefficient (KLAF(KSTRL)) with a value of the first feedback correction coefficient (KSTR) such that the second feedback correction coefficient (KLAF(KSTRL)) becomes close to the first feedback correction coefficient (KSTR), when said switching means switches the feedback correction coefficient from the first (KSTR) to the second (KLAF(KSTRL)).

5. A system according to claim 1, wherein the value of the first feedback correction coefficient (KSTR) is that calculated at a preceding control cycle.

6. A system according claim 2, wherein said switching means replaces the variable when the detected air/fuel ratio (KACT) is within a predetermined range.

7. A system according to claim 6, wherein said predetermined range is 1.0 or thereabout in terms of an equivalence ratio.

8. A system according to claim 2, wherein said first feedback correction coefficient calculation means includes:

comparing means for comparing the first feedback correction coefficient with a threshold value (KSTRref1);

and said switching means replaces the variable with a value when the first feedback correction coefficient (KSTR) is below a threshold value.

9. A system according to claim 8, wherein said first feedback correction coefficient calculation means includes:

second comparing means for comparing the first feedback correction coefficient (KSTR) with a second threshold value (KSTRref2);

and said first feedback correction coefficient means resets the first feedback correction coefficient (KSTR) to an initial value of the first feedback correction coefficient (KSTR), when the first feedback correction coefficient (KSTR) exceeds the second threshold value.

10. A system according to claim 4, wherein said switching means replaces the variable when an engine coolant temperature is less than a prescribed temperature.

11. A system according to claim 4, wherein said switching means replaces the variable when an engine speed is not less than a prescribed speed.

12. A system according to claim 4, wherein said switching means replaces the variable when the engine is idling.

13. A system according to claim 4, wherein said switching means replaces the variable when an engine load is low.

14. A system according to claim 2, wherein said second feedback correction coefficient calculation means calculates the second feedback correction coefficient (KLAF) using a PID control law at least including one from among a proportional term, an integral term and a differential term.

15. A system according to claim 4, wherein said second feedback correction coefficient calculation means calculates the second feedback correction coefficient (KLAF) using a PID control law at least including one from among a proportional term, an integral term and a differential term.

16. A system according to claim 14, wherein the one (KLAFI) of the second feedback correction coefficient (KLAF(KSTRL)) is the integral term.

17. A system according to claim 2, wherein said second feedback correction coefficient calculation means calculates the second feedback correction coefficient (KSTRL) using the second control law that has an algorithm expressed in a recursion formula.

18. A system according to claim 17, wherein the second control law that has an algorithm expressed in a recursion formula is an adaptive control law.

19. A system according to claim 4, wherein said second feedback correction coefficient calculation means calculates the second feedback correction coefficient (KSTRL) using the second control law that has an algorithm expressed in a recursion formula.

20. A system according to claim 19, wherein the second control law that has an algorithm expressed in a recursion formula is an adaptive control law.

21. A system according to claim 2, wherein the first control law having an algorithm expressed in a recursion formula is an adaptive control law.

22. A system according to claim 4, wherein said feedback control means corrects the manipulated variable by multiplying the manipulated variable by one of the feedback correction coefficients (KSTR, KLAF(KSTRL)).

23. A system for controlling fuel metering for an internal combustion engine, comprising:

air/fuel ratio detecting means for detecting an air/fuel ratio (KACT) of an exhaust gas of the engine;

engine operating condition detecting means for detecting an operating condition of the engine;

fuel injection quantity determining means for determining a quantity of fuel injection (Tim) to be supplied to the engine;

first feedback correction coefficient calculation means for calculating a first feedback correction coefficient (KSTR) using a first control law having an algorithm expressed in recursion formula;

second feedback correction coefficient calculation means for calculating a second feedback correction coefficient (KLAF(KSTRL)), whose control response is inferior to that of the first feedback correction coefficient, using a second control law;

switching means for switching the first feedback correction coefficient (KSTR) and the second feedback correction coefficient (KLAF(KSTRL)) therebetween; and feedback control means for correcting a manipulated variable by the switched one of the feedback correction coefficients (KSTR, KLAF(KSTRL)) to bring at least one of the detected air/fuel ratio (KACT) and the quantity of fuel injection (Tim) to a desired value (KCMD);

wherein said feedback control means correcting the manipulated variable by the second feedback correction coefficient (KLAF(KSTRL)) at a specific condition when returning from open-loop to the feedback control.

24. A system according to claim 23, wherein the specific condition is a condition just after returning from the open-loop.

25. A system according to claim 23, wherein the specific condition is a condition in which it is in a predetermined period (C) after returning from the open-loop.

26. A system according to claim 23, wherein the returning from open-loop to the feedback control is a time of resuming of supply of fuel that has once been cut off.

27. A system according to claim 23, wherein the first control law having an algorithm expressed in a recursion formula is an adaptive control law.

28. A system according to claim 23, wherein said second feedback correction coefficient calculation means calculates the second feedback correction coefficient (KLAF) using a PID control law at least including one from among a proportional term, an integral term and a differential term.

29. A system according to claim 23, wherein said feedback control means corrects the manipulated variable by multiplying the manipulated variable by one of the feedback correction coefficients (KSTR, KLAF(KSTRL)).

* * * * *